US010995478B2

(12) United States Patent
Bilal et al.

(10) Patent No.: US 10,995,478 B2
(45) Date of Patent: May 4, 2021

(54) STABILIZING FEATURES IN A WEAR MEMBER ASSEMBLY

(71) Applicant: Hensley Industries, Inc., Dallas, TX (US)

(72) Inventors: Mohamad Bilal, Little Elm, TX (US); Isai Diaz, Arlington, TX (US)

(73) Assignee: Hensley Industries, Inc., Dallas, TX (US)

( * ) Notice: Subject to any disclaimer, the term of this patent is extended or adjusted under 35 U.S.C. 154(b) by 0 days.

(21) Appl. No.: 16/887,143

(22) Filed: May 29, 2020

(65) Prior Publication Data

US 2020/0291620 A1 Sep. 17, 2020

Related U.S. Application Data

(60) Division of application No. 16/687,432, filed on Nov. 18, 2019, which is a continuation of application No. (Continued)

(51) Int. Cl.
*E02F 9/28* (2006.01)

(52) U.S. Cl.
CPC ..... *E02F 9/2825* (2013.01); *E02F 9/2816* (2013.01); *E02F 9/2833* (2013.01); (Continued)

(58) Field of Classification Search
CPC ..... E02F 9/2816; E02F 9/2825; E02F 9/2858
(Continued)

(56) References Cited

U.S. PATENT DOCUMENTS 2,259,456 A 5/1940 Crawford
2,250,904 A 7/1941 Coffman
(Continued)

FOREIGN PATENT DOCUMENTS

CN 102864813 A 1/2013
DE 4345100 A1 7/1995
(Continued)

OTHER PUBLICATIONS

International Search Report and Written Opinion for Application No. PCT/US2017/032235, dated Jul. 18, 2017, 13 pgs.
(Continued)

*Primary Examiner* — Gary S Hartmann
(74) *Attorney, Agent, or Firm* — Haynes and Boone, LLP

(57) ABSTRACT

A support structure includes a nose arranged to fit within a cavity of the wear member. The nose may include a front portion having a plurality of outwardly facing surfaces that may be angled with respect to a longitudinal axis of the nose at a first angle. The nose may also include a rear portion having two horizontally separated outwardly facing surfaces and two vertically separated outwardly facing surfaces. The horizontally separated outwardly facing surfaces and the vertically separated outwardly facing surfaces may be angled with respect to the longitudinal axis at a second angle that is different than the first angle. A first concave surface and a second concave surface may each be positioned on one of the vertically separated outwardly facing surfaces, may be disposed only in the rear portion and may be shaped to form an arc. A through-hole may extend between the two horizontally separated outwardly facing surfaces. Each hole of the pair of holes may be arranged to receive a locking pin, and the first and second concave surfaces may be positioned at least partially rearward of the pair of holes.

7 Claims, 28 Drawing Sheets

Related U.S. Application Data

16/541,463, filed on Aug. 15, 2019, now Pat. No. 10,808,383, which is a continuation of application No. 15/589,647, filed on May 8, 2017, now Pat. No. 10,508,418.

(60) Provisional application No. 62/335,789, filed on May 13, 2016, provisional application No. 62/441,779, filed on Jan. 3, 2017.

(52) U.S. Cl.
CPC ..... *E02F 9/2858* (2013.01); *E02F 9/2883* (2013.01); *E02F 9/2808* (2013.01)

(58) Field of Classification Search
USPC ..... 37/450, 453, 455
See application file for complete search history.

(56) References Cited

U.S. PATENT DOCUMENTS 2,891,333 A * 6/1959 Van Buskirk ..... E02F 9/2825 37/452
3,117,386 A 1/1964 Ferwerda
3,496,658 A 2/1970 Eyolfson
3,508,352 A 4/1970 Radwill
3,675,350 A * 7/1972 Mulcahy ..... E02F 9/2841 37/457
4,133,121 A 1/1979 Hemphill
4,335,532 A 6/1982 Hahn
4,404,760 A 9/1983 Hahn et al.
4,481,728 A 11/1984 Mulder et al.
4,716,667 A 1/1988 Martin
4,823,487 A 4/1989 Robinson
5,016,365 A 5/1991 Robinson
5,074,062 A 12/1991 Hahn
5,075,986 A 12/1991 Smith et al.
5,144,762 A 9/1992 Robinson
5,152,088 A 10/1992 Hahn
5,233,770 A 8/1993 Robinson
5,361,520 A 11/1994 Robinson
5,394,629 A 3/1995 Ruvang et al.
5,423,138 A 6/1995 Livesay et al.
D363,074 S 10/1995 Ruvang
D365,109 S 12/1995 Robinson et al.
D365,577 S 12/1995 Ruvang
5,491,915 A 2/1996 Robinson
5,709,043 A 1/1998 Jones
5,718,070 A 2/1998 Ruvang
5,918,391 A 7/1999 Vinas Peya
5,937,550 A 8/1999 Emrich
6,018,896 A 2/2000 Adamic
6,032,390 A 3/2000 Bierwith
6,041,529 A 3/2000 Ruvang
6,108,950 A 8/2000 Ruvang et al.
D435,567 S 12/2000 Clendenning
6,209,238 B1 4/2001 Ruvang
6,240,663 B1 6/2001 Robinson
6,247,255 B1 6/2001 Clendenning
D446,224 S 8/2001 Glendenning
6,321,471 B2 11/2001 Fernandez Munoz et al.
6,393,739 B1 5/2002 Shamblin et al.
6,439,796 B1 8/2002 Ruvang et al.
D471,565 S 3/2003 Toral Rodriguez
6,564,482 B2 5/2003 Ruvang
6,708,431 B2 3/2004 Robinson et al.
6,735,890 B2 5/2004 Carpenter et al.
6,799,386 B2 10/2004 Robinson et al.
6,826,855 B2 12/2004 Ruvang
6,836,983 B2 1/2005 Pallas Moreno et al.
6,865,828 B1 3/2005 Molino et al.
6,976,325 B2 12/2005 Robinson et al.
6,993,861 B2 2/2006 Carpenter
7,069,676 B2 7/2006 Robinson et al.
7,086,185 B2 8/2006 Pasqualini et al.
7,121,023 B2 10/2006 Robinson et al.
7,162,818 B2 1/2007 Ruvang et al.
7,178,274 B2 2/2007 Emrich
7,367,144 B2 5/2008 Jones et al.
D602,205 S 10/2009 Ruvang
7,603,799 B2 10/2009 Campomanes
7,681,341 B2 3/2010 Ruvang
D614,206 S 4/2010 Ruvang
D614,207 S 4/2010 Ruvang
7,707,755 B2 5/2010 Lopez Almendros et al.
7,730,651 B2 6/2010 Carpenter
RE41,855 E 10/2010 Ruvang et al.
7,882,649 B2 2/2011 Carpenter et al.
7,926,207 B2 4/2011 Lopez Almendros et al.
7,980,011 B2 7/2011 Ruvang
8,122,621 B2 2/2012 Carpenter et al.
8,127,475 B2 3/2012 Harder et al.
RE43,693 E 10/2012 Emrich
8,356,432 B2 * 1/2013 Carpenter ..... E02F 9/28 37/452
8,387,290 B2 3/2013 Campomanes et al.
8,393,097 B2 3/2013 Harder et al.
8,555,532 B2 10/2013 Lopez Almendros et al.
8,689,472 B2 4/2014 Carpenter et al.
8,839,535 B2 9/2014 Carpenter et al.
8,844,175 B2 9/2014 Snyder
8,898,937 B2 12/2014 Campomanes
8,904,677 B2 12/2014 Cui
8,959,806 B2 2/2015 Zamorano Jones
8,997,384 B2 4/2015 Bartolome
D728,635 S 5/2015 Kunz
9,080,313 B2 7/2015 Goodwin
9,085,876 B2 * 7/2015 Swinscoe ..... E02F 9/2833
9,121,160 B2 * 9/2015 Hughes ..... E02F 9/2891
9,222,243 B2 * 12/2015 Cheyne ..... E02F 9/2825
9,290,915 B2 3/2016 Marchand
9,428,886 B2 8/2016 Renski et al.
9,534,357 B2 1/2017 Haslett
9,677,252 B2 * 6/2017 Simpson ..... E02F 9/2833
9,822,511 B2 * 11/2017 Tuto Faja ..... E02F 9/2858
9,850,641 B2 12/2017 Hughes
10,294,637 B2 5/2019 Soria
10,508,418 B2 * 12/2019 Bilal ..... E02F 9/2825
10,787,794 B2 * 9/2020 Bilal ..... E02F 9/2816
10,801,188 B2 * 10/2020 Bilal ..... E02F 9/2825
10,808,383 B2 * 10/2020 Bilal ..... E02F 9/2816
2003/0070330 A1 4/2003 Olds et al.
2003/0101627 A1 6/2003 Robinson et al.
2003/0140531 A1 7/2003 Pippins
2004/0093771 A1 5/2004 Carpenter et al.
2008/0201997 A1 8/2008 Armstrong
2008/0209772 A1 9/2008 Cui
2010/0229433 A1 9/2010 Leslie et al.
2011/0131843 A1 6/2011 Carpenter
2012/0051836 A1 3/2012 Jakubisin
2012/0137493 A1 6/2012 Carpenter et al.
2012/0260539 A1 10/2012 Guimaraes et al.
2012/0311895 A1 12/2012 Goodwin
2013/0152433 A1 6/2013 Itou et al.
2013/0174453 A1 7/2013 Cheyne et al.
2013/0180137 A1 7/2013 Hurley et al.
2013/0247428 A1 9/2013 Hughes
2014/0331529 A1 11/2014 Guimaraes et al.
2014/0360062 A1 12/2014 Marchand
2014/0366408 A1 12/2014 Campomanes
2015/0113839 A1 4/2015 Bilal
2015/0176259 A1 6/2015 Bilal
2015/0337897 A1 11/2015 Griewenka
2015/0368884 A1 12/2015 Cheyne et al.
2017/0328035 A1 11/2017 Bilal et al.
2019/0368165 A1 * 12/2019 Bilal ..... E02F 9/2858
2020/0080288 A1 3/2020 Bilal
2020/0109539 A1 * 4/2020 Bilal ..... E02F 9/2833
2020/0181887 A1 6/2020 Quarfordt

(56) References Cited

U.S. PATENT DOCUMENTS

| | | | | |
|---|---|---|---|---|
| 2020/0291618 | A1* | 9/2020 | Bilal | E02F 9/2825 |
| 2020/0291619 | A1* | 9/2020 | Bilal | E02F 9/2833 |

FOREIGN PATENT DOCUMENTS

| | | | |
|---|---|---|---|
| EP | 2910692 | A2 | 8/2015 |
| GB | 942987 | A | 11/1963 |
| JP | S568662 | U | 1/1981 |
| JP | H05-071259 | | 9/1993 |
| WO | 2010089432 | | 8/2010 |
| WO | 2015165504 | A1 | 11/2015 |

OTHER PUBLICATIONS

International Search Report and Written Opinion for Application No. PCT/US2017/032242, dated Aug. 14, 2017, 14 pgs.
Korean Office Action issued Oct. 23, 2019 in Korean Application 10-2018-7036100, 9 pages.
European Patent Office, "Extended European Search Report" for Application No. 17796874.0, dated Mar. 10, 2020, 21 pages.

* cited by examiner

1400

STABILIZING FEATURES IN A WEAR MEMBER ASSEMBLY

CROSS-REFERENCE TO RELATED APPLICATIONS

This application is a divisional of Ser. No. 16/687,432, filed Nov. 18, 2019, and entitled "STABILIZING FEATURES IN A WEAR MEMBER ASSEMBLY," which is a continuation of Ser. No. 16/541,463, filed Aug. 15, 2019 and entitled "STABILIZING FEATURES IN A WEAR MEMBER ASSEMBLY," which is a continuation of Ser. No. 15/589,647, filed May 8, 2017 and entitled "STABILIZING FEATURES IN A WEAR MEMBER ASSEMBLY," which claims the benefit of U.S. Provisional Applications No. 62/441,779, filed Jan. 3, 2017 and entitled "STABILIZING FEATURES IN A WEAR MEMBER ASSEMBLY," and 62/335,789, filed May 13, 2016 and entitled "WEAR MEMBER STABILIZATION SYSTEM WITH OCTAGONAL INTERFACE." The full disclosures of all of the above listed applications (including all references incorporated by reference therein) are incorporated by reference herein for all purposes.

TECHNICAL FIELD

This disclosure is generally directed to ground engaging wear member assemblies including adapters for securing excavating wear members to bucket lips. More particularly, this disclosure is directed to stabilising load bearing surfaces between adjacent wear members.

BACKGROUND

Material displacement apparatuses, such as excavating buckets found on construction, mining, and other earth moving equipment, often include replaceable wear portions such as earth engaging teeth. These are often removably attached to larger base structures, such as excavating buckets, and come into abrasive, wearing contact with the earth or other material being displaced. For example, excavating tooth assemblies provided on digging equipment, such as excavating buckets and the like, typically comprise a relatively massive adapter portion which is suitably anchored to the forward bucket lip. The adapter portion typically includes a forwardly projecting nose. A replaceable tooth typically includes a rear-facing cavity that releasably receives the adapter nose. To retain the tooth on the adapter nose, generally aligned transverse openings may be formed on both the tooth and the adapter nose, and a suitable connector structure is driven into and forcibly retained within the aligned openings to releasably anchor the replaceable tooth on its associated adapter nose.

During normal operations, the tooth experiences loading in multiple directions. If the tooth is not positioned on the nose in a stable manner, the loads experienced by the tooth can cause additional wear on the adapter. A need accordingly exists for an improved adapter nose and corresponding opening in the tooth.

SUMMARY

According to some example implementations, a wear member assembly may include a nose attachable to a bucket lip. The nose may include a rear portion having a first set of eight substantially planar surfaces converging toward a longitudinal axis of the nose towards a distal end of the rear portion. The first set of substantially planar surfaces may include a first subset of surfaces having a top and bottom surface, a second subset of side surfaces, and a third subset of surfaces that comprise bearing surfaces. The third subset of surfaces being angled and positioned between the first subset of surfaces and the second subset of surfaces. The nose may also include a forward portion positioned forwardly adjacent to the rear portion, the forward portion having a second set of eight substantially planar surfaces converging toward the longitudinal axis of the nose towards the distal end of the forward portion. The second set of substantially planar surfaces may include a fourth subset having a top and bottom surface, a fifth subset of side surfaces, and a sixth subset of surfaces that comprise bearing surfaces, the sixth set of surfaces being angled and positioned between the first subset of surfaces and the second subset of surfaces. The wear member assembly may also include a wear member having a cavity opening toward a rearward end, the cavity comprising rear and forward bearing surfaces corresponding to the third subset of surfaces and the sixth subset of surfaces.

According to some example implementations, a wear member includes a cavity having a rear portion having a first set of eight surfaces converging toward a longitudinal axis at a first angle towards a distal end of the rear portion. The first set of substantially planar surfaces may include a top and bottom surface, a set of side surfaces, and a set of diagonal surfaces that comprise bearing surfaces. The cavity may further include a forward portion positioned forwardly adjacent to the rear portion, the forward portion having a second set of eight surfaces converging toward the longitudinal axis at a second angle that is less than the first angle. The cavity may further include a set of pockets positioned at least partially along the diagonal surfaces, the pockets having inwardly facing vertical surfaces.

According to some example implementations, a wear member assembly may include an adapter nose having a rear portion having a cross-sectional width and a cross-sectional height, the cross-sectional width being different than the cross-sectional height, the rear portion having two non-bearing surfaces and four substantially planar bearing surfaces, the two non-bearing surfaces being substantially horizontal in cross-section and the four substantially planar bearing surfaces being oblique in cross-section, a first two of the four substantially planar bearing surfaces being disposed on a first lateral side of the two substantially planar non-bearing surfaces, and a second two of the four substantially planar bearing surfaces being disposed on a second lateral side of the two substantially planar non-bearing surfaces, wherein at a distal end of the rear portion, the cross-sectional width of either of the two non-bearing surfaces is different than the cross-sectional width of any one of the four substantially bearing surfaces.

According to some example implementations, a wear member includes a cavity having rear portion and a forward portion. The rear portion may have a cross-sectional width and a cross-sectional height, the cross-sectional width being different than the cross-sectional height. The cavity may have two substantially planar non-bearing surfaces and four substantially planar bearing surfaces. The two substantially planar non-bearing surfaces may be substantially horizontal in cross-section and the four substantially planar bearing surfaces may be oblique in cross-section. A first two of the four substantially planar bearing surfaces may be disposed on a first lateral side of the two substantially planar non-bearing surfaces, and a second two of the four substantially planar bearing surfaces may be disposed on a second lateral side of the two substantially planar non-bearing surfaces. At a distal end of the rear portion, the cross-sectional width of either of the two substantially planar non-bearing surfaces may be different than the cross-sectional width of any one of the four substantially bearing surfaces.

The present disclosure is directed to a wear member assembly having a particularly shaped bearing surface disposed on a wear member nose, such as an adapter nose, and a corresponding shaped bearing surface on an additional wear member introduced over the nose. It is to be understood that both the foregoing general description and the following drawings and detailed description are exemplary and explanatory in nature and are intended to provide an understanding of the present disclosure without limiting the scope of the present disclosure. In that regard, additional aspects, features, and advantages of the present disclosure will be apparent to one skilled in the art from the following.

The present disclosure is directed to stabilizing load bearing surfaces on wear members that provide stability and support during ground engaging digging/material displacement operations. In some implementations, the present disclosure describes a hollow ground-engaging wear member attachable to a support structure may include a leading end arranged to engage ground and a rear end having a cavity formed therein. The cavity may have an inner surface and having a longitudinally extending axis and a front portion and having a rear portion adjacent the rear end. The inner surface may have horizontally separated opposing inner walls and having vertically separated opposing inner walls forming an upper inner surface and a lower inner surface. The upper inner surface and the lower inner surface may each have a centrally disposed, inwardly protruding bearing surface portion arranged to provide a bearing fit with the support structure. Each inwardly protruding bearing surface portion may be disposed in the rear portion of the cavity and may have a transverse width less than a longitudinal length and receivable in a depression of the support structure. The inwardly protruding bearing surface portion may be arranged to support vertically imposed loads at the leading end.

According to some example implementations, the present disclosure is directed to a support structure arranged to receive a wear member, the support structure may include a nose arranged to receive a cavity of the wear member. The nose may include a front portion having a plurality of outwardly facing surfaces, the outwardly facing surfaces angled with respect to a longitudinal axis of the nose at a first angle. The nose may further include a rear portion having two horizontally separated outwardly facing surfaces, and two vertically separated outwardly facing surfaces including an upward surface and a downward surface, the horizontally separated outwardly facing surfaces and the vertically separated outwardly facing surfaces being angled with respect to the longitudinal axis at a second angle that is different than the first angle. The nose may further include a first concave bearing surface positioned on the upward facing surface. The nose may further include a second concave bearing surface positioned on the downward facing surface.

According to additional example implementations, the present disclosure is directed to a wear member may include a cavity arranged to fit over a nose of an adapter. The cavity may include a front portion having a plurality of inwardly facing surfaces, the inwardly facing surfaces angled with respect to a longitudinal axis of the cavity at a first angle. The cavity may include a rear portion having two horizontally separated inwardly facing surfaces, and two vertically separated inwardly facing surfaces including an upward surface and a downward surface, the horizontally separated inwardly facing surfaces and the vertically separated inwardly facing surfaces being angled with respect to the longitudinal axis at a second angle that is different than the first angle. The cavity may include a first convex bearing surface positioned on the upward facing surface. The cavity may include a second convex bearing surface positioned on the downward facing surface.

According to yet more example implementations, the present disclosure is directed to a wear member assembly may include an adapter having a rear end arranged to secure the adapter to a bucket lip and a forward end having a nose. The wear member may also include an upward facing substantially planar surface at least partially circumscribing an upward facing concave bearing surface and a downward facing substantially planar surface at least partially circumscribing a downward facing concave bearing surface. The wear member assembly may also include a wear member having a forward end arranged to engage ground and a rear end having a cavity. The cavity may include a downward facing surface having a first outward protrusion extending therefrom, the first outward protrusion arranged to fit within the upward facing concave bearing surface. The cavity may include an upward facing surface having a second outward protrusion extending therefrom, the second outward protrusion arranged to fit within the downward facing concave bearing surface.

BRIEF DESCRIPTION OF THE DRAWINGS

The accompanying drawings illustrate implementations of the systems, devices, and methods disclosed herein and together with the description, serve to explain the principles of the present disclosure.

Figure 1:
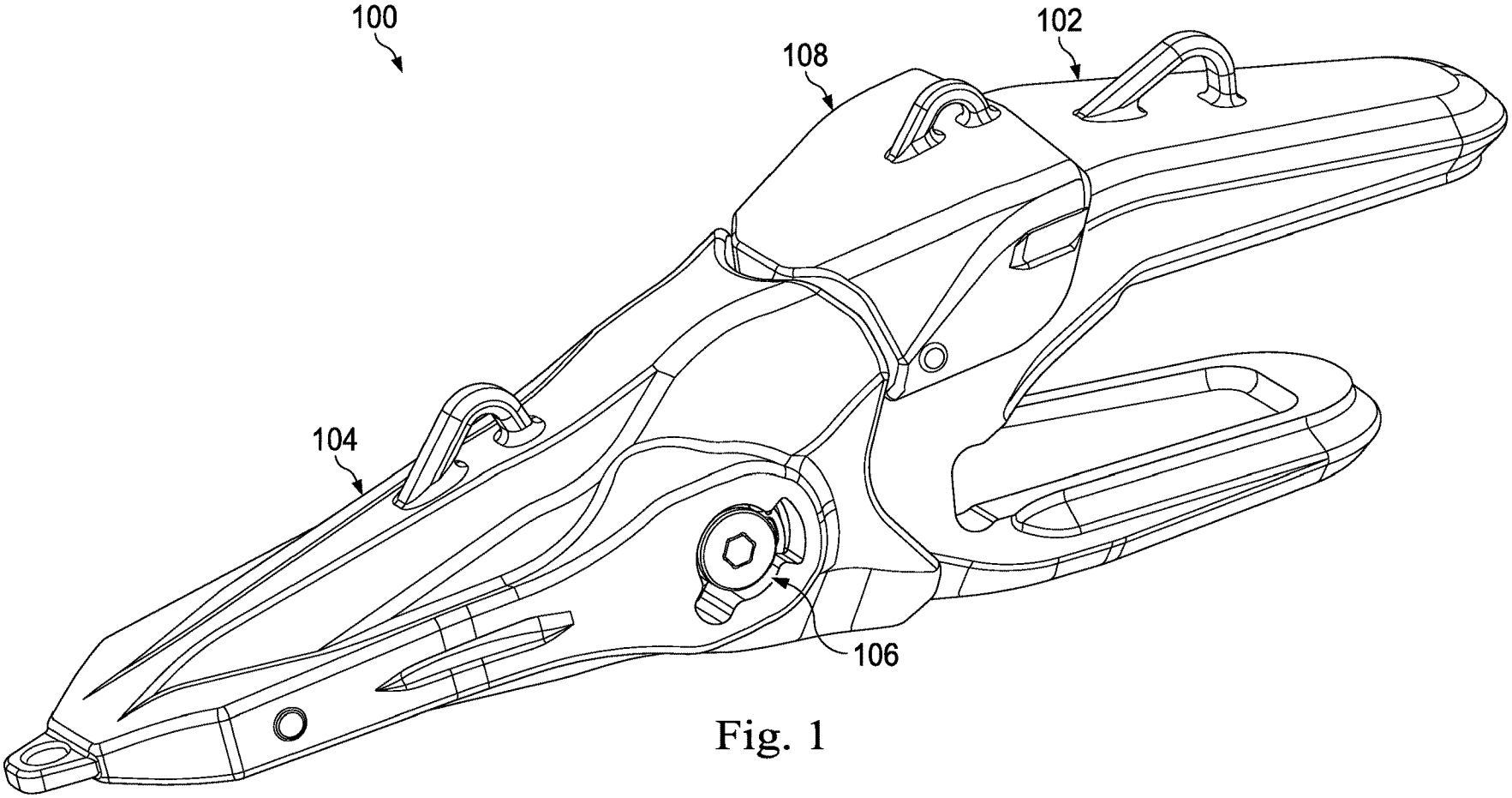
FIG. 1 is view of an earth engaging wear member assembly according to an example incorporating principles described herein.

These Figures will be better understood by reference to the following detailed description.

DETAILED DESCRIPTION

For the purposes of promoting an understanding of the principles of the present disclosure, reference will now be made to the implementations illustrated in the drawings and specific language will be used to describe them. It will nevertheless be understood that no limitation of the scope of the disclosure is intended. Any alterations and further modifications to the described devices, instruments, methods, and any further application of the principles of the present disclosure are fully contemplated as would normally occur to one skilled in the art to which the disclosure relates. In addition, this disclosure describes some elements or features in detail with respect to one or more implementations or Figures, when those same elements or features appear in subsequent Figures, without such a high level of detail. It is fully contemplated that the features, components, and/or steps described with respect to one or more implementations or Figures may be combined with the features, components, and/or steps described with respect to other implementations or Figures of the present disclosure. For simplicity, in some instances the same or similar reference numbers are used throughout the drawings to refer to the same or like parts.

The present disclosure is directed to an earth engaging wear member assembly that includes an adapter nose securable to a bucket lip. The earth engaging wear member assembly also includes a tooth or other wear member, such as an intermediate adapter, that is securable to the adapter nose. The wear member includes a rear facing cavity designed to fit over the adapter nose. The nose may include a front set of surfaces and a rear set of surfaces, and in some implementations, both the front set of surfaces and the rear set of surfaces may form a substantially octagonal shape in transverse cross-section. Various surfaces of both the front set of surfaces and the rear set of surfaces may be fit (or bearing) surfaces while other surfaces of the front set of surfaces and rear set of surfaces may be non-fit (or non-bearing) surfaces. In some particular embodiments, the top surface and the bottom surface of the rear set of surfaces may be fit surfaces and include an interference bearing feature such as a protrusion on one of the tooth or adapter and a matching indent on the other of the tooth or adapter. These may cooperate to distribute vertical loading in a manner assisting with stability and alignment of the wear member on the adapter nose. As used herein, a fit surface is a load bearing surface.

In some implementations, the adapter of the earth engaging wear assembly includes fit surfaces on angled side surfaces. These fit surfaces may be disposed in a manner that provides stabilizing contact on more than one fit surface when the earth engaging wear assembly is subjected to a vertical load or a horizontal load. For example, an applied vertical downward load may be supported by two angled fit surfaces, and an applied vertical upward load may be supported by two separate angled fit surfaces. Likewise, a left horizontal load may be supported by two angled fit surfaces and a right horizontal load may be supported by two angled fit surfaces. In some implementations, a set of angled fit surfaces are disposed at a distal or leading portion of the adapter nose and another set of angled fit surfaces are disposed at a proximal or trailing portion of the adapter nose. In this manner, a wear member, such as a tooth, may be supported by angled fit surfaces at both at the distal end and the proximal end of the adapter nose.

FIG. 1 is view of an exemplary earth engaging wear member assembly 100 according to one example of the present disclosure. In the implementation shown, the earth engaging wear member assembly 100 includes a tooth (or wear member) 104, an adapter 102, and a locking pin 106. In this example, the wear assembly 100 also includes a shroud wear member 108. The adapter 102 includes a hole (not shown) for receiving the locking pin 106. The tooth 104 also includes a hole through which the locking pin 106 can be inserted. The locking pin 106 may secure the tooth 104 onto the adapter 102. The adapter 102 may also be referred to herein as a support structure since it provides stabilizing support to an additional component, which in this implementation is the tooth 104.

Figure 2:
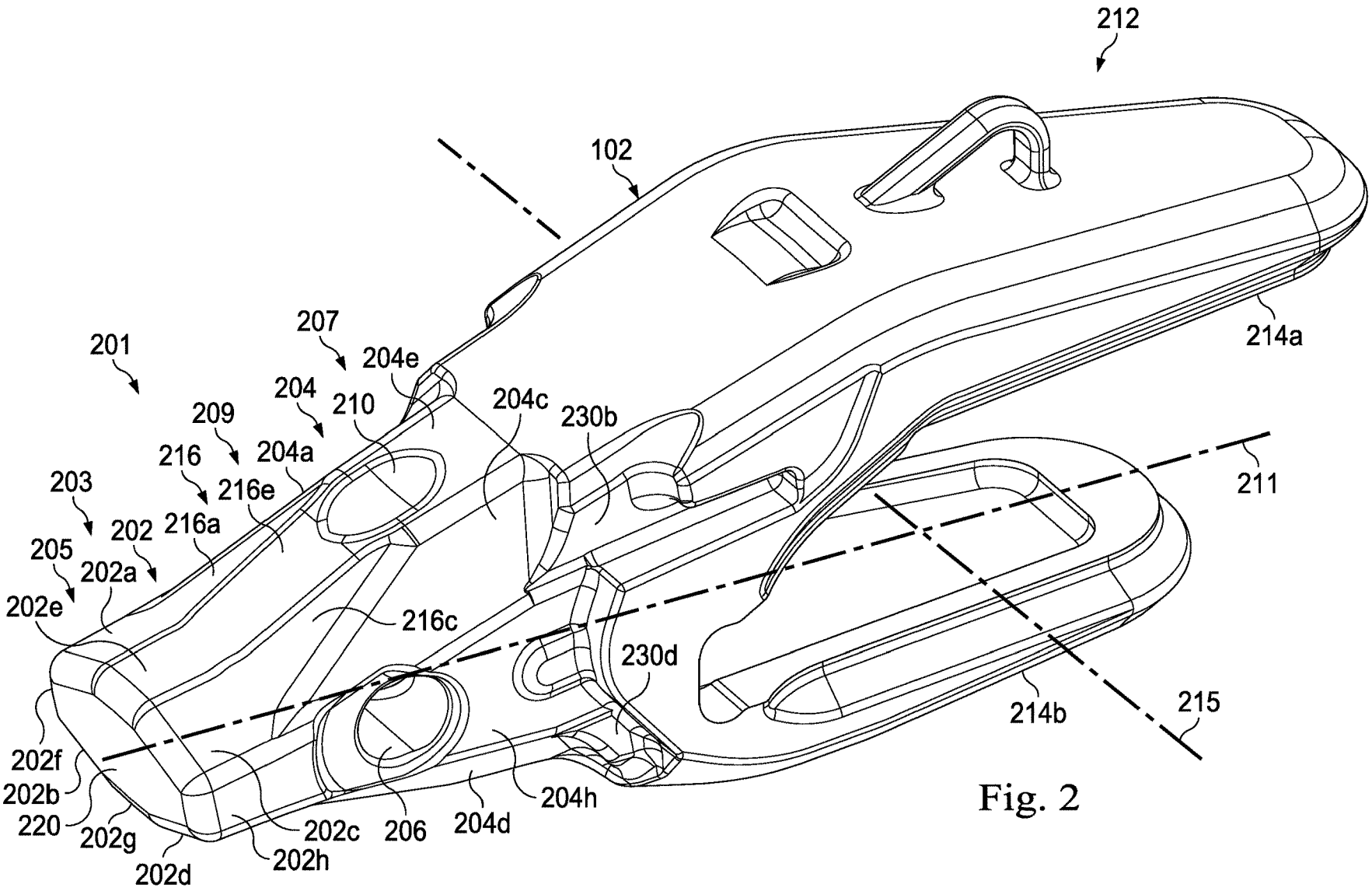
FIG. 2 illustrates a perspective view of an adapter nose with a bearing surface portion on a top and bottom surface according to an example incorporating principles described herein.

FIG. 2 illustrates a perspective view of the adapter 102. According to the present example, the adapter 102 includes a front end 201 and a rear end 212. The front end 201 includes a nose 203 and the rear end 212 includes a pair of bifurcated legs 214*a*, 214*b* arranged to secure the adapter 102 to a bucket lip (not shown). A longitudinal axis 211 is shown through the front and 201 and the rear end 212. A transverse axis 215 is shown for reference in a position that would run parallel to an edge of the bucket lip (not shown).

According to the present example, the nose 203 includes a front portion 205, a rear portion 207, and an intermediate portion 209 extending between the front portion 205 and the rear portion 207. The front portion 205 includes a forward facing end surface 220 and a plurality of outwardly facing surfaces 202 in an octagonal arrangement adjacent the end surface 220. In this implementation, each of the surfaces 202 is angled with respect to the longitudinal axis 211. Further, at least four of the surfaces are angled relative to the transverse axis 215. In some examples, at least four of the plurality of surfaces 202 may be load bearing fit surfaces. For example, in some implementations, the surfaces 202 may include angled surfaces 202*a*, 202*b*, 202*c*, and 202*d* as load bearing fit surfaces. In other implementations, the surfaces 202 may include vertical and horizontal surfaces 202*e*, 202*f*, 202*g*, and 202*h* as load bearing fit surfaces. In some implementations, each of the surfaces 202 may be substantially planar, while in other implementations, only four of the eight surfaces 202 are substantially planar. In yet other implementations, a different number of the eight surfaces 202 are substantially planar.

In the present example, the rear portion 207 also includes a plurality of outwardly facing surfaces 204 in an octagonal arrangement. Each of the surfaces 204 are angled with respect to the longitudinal axis. Each of the rear surfaces 204 may be angled differently with respect to the longitudinal axis. For example, the side surfaces 204*f*, 204*h* may be angled differently with respect to the longitudinal axis than are the top and bottom surfaces 204*e*, 204*g*. In the present example, the rear surfaces 204 are angled with respect to the longitudinal axis at a different angle than the front surfaces 202. Specifically, the rear surfaces 204 are angled at a greater angle with respect to the longitudinal axis than the front surfaces 202. In the examples the various front surfaces 202 may have different angles with respect to the longitudinal axis. Likewise, the rear surfaces 204 have different angles with respect to the longitudinal axis. In such examples, the average angle at which each of the rear surfaces 204 converges toward the longitudinal axis may be greater than the average angle at which the front surfaces 202 converge towards the longitudinal axis. As shown in the perspective view of FIG. 2, the rear surfaces 204 include angled surfaces 204*a*, 204*b*, 204*c*. The opposing side of the nose 203 includes an additional angled surface 204*d*, which is identified in FIGS. 4A and 4B, for example. The rear surfaces 204 also include a top surface 204*e* and a side surface 204*h*. The nose 203 also includes a bottom surface 204*g* and an opposite side surface 204*f* which are identified in FIGS. 4A and 4B, for example. The rear surfaces 204 may also be bearing or fit surfaces. In some examples, each of the rear surfaces 204 may be bearing fit surfaces. In some examples, only the angled surfaces 204*a*, 204*b*, 204*c*, 204*d* may be fit surfaces. In some examples, only the horizontal and vertical surfaces 204*e*, 204*f*, 204*g*, 204*h*, may be fit surfaces. In some implementations, each of the surfaces 204 may be substantially planar, while in other implementations, only four of the eight surfaces 204 are substantially planar. In yet other implementations, a different number of the surfaces 204 are substantially planar.

Figure 3A:
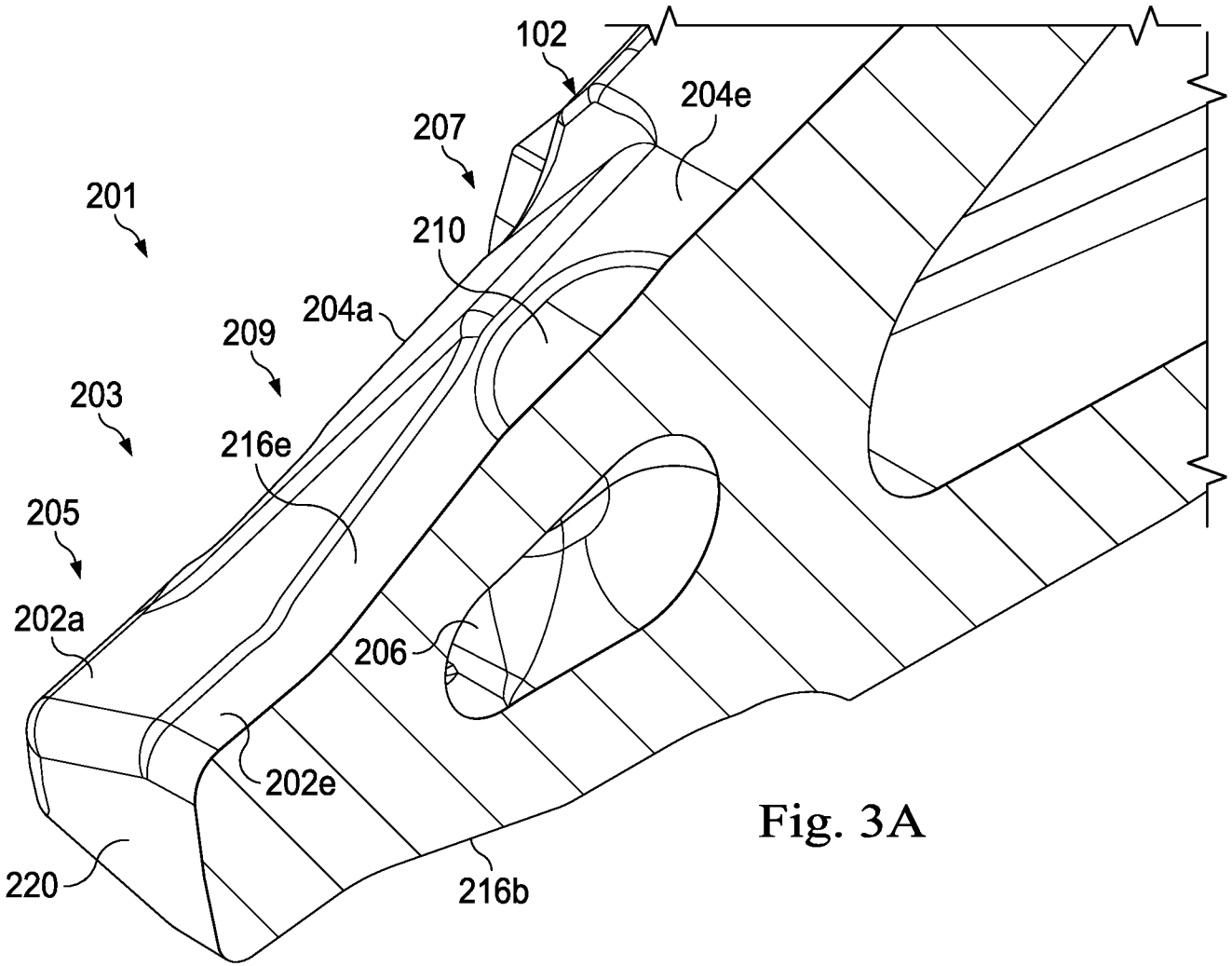
FIGS. 3A and 3B are diagrams showing longitudinal cross-sectional views of the bearing surface portion in the nose of the adapter according to an example incorporating principles described herein.
Figure 3B:
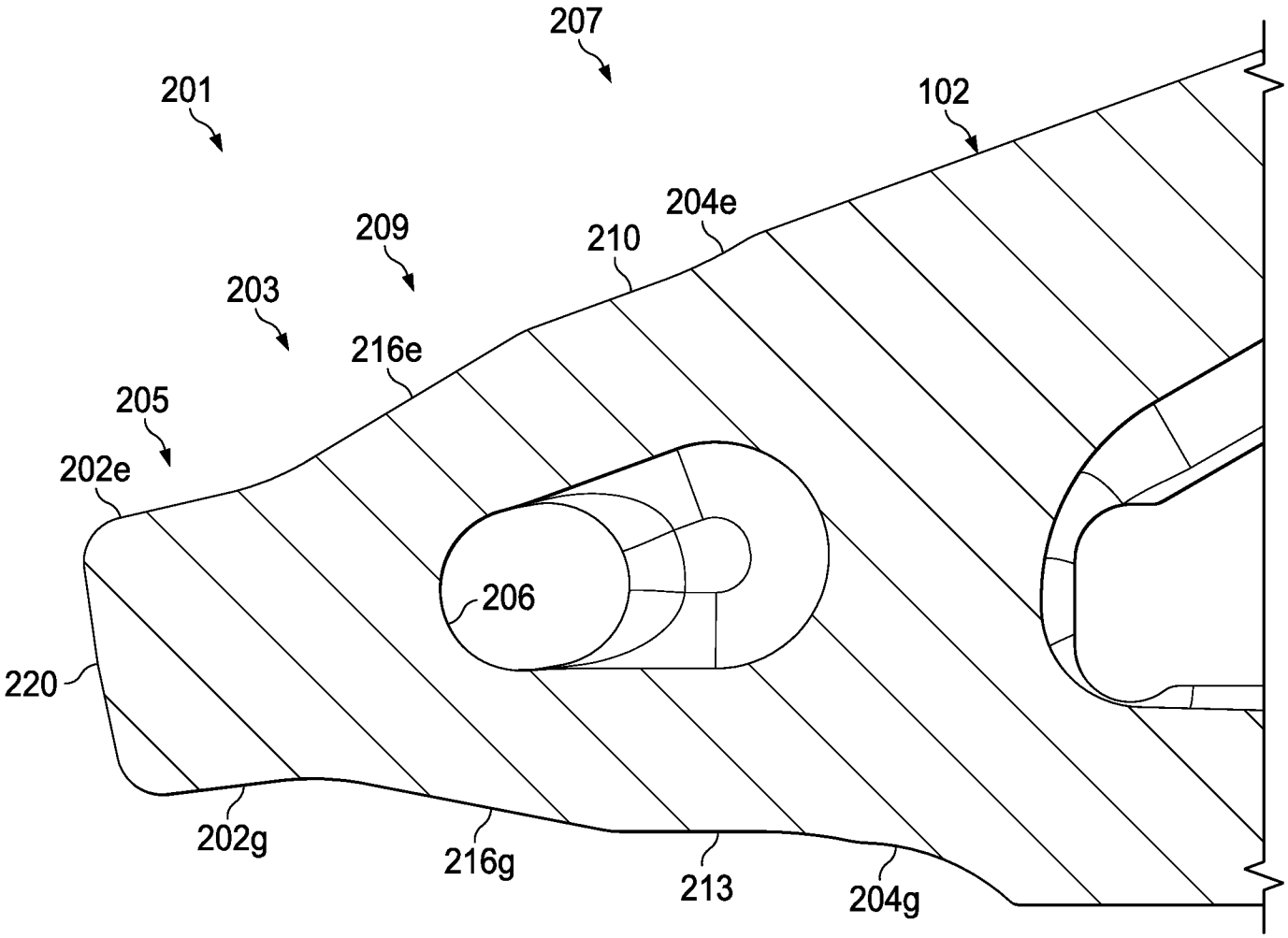

In the present example, the intermediate portion 209 includes a plurality of outwardly facing surfaces 216. These outwardly facing surfaces 216 may extend between and intersect the surfaces 202 and the surfaces 204. In some implementations, the surfaces 216 may be angled differently than the surfaces 202 and the surfaces 204 relative to the longitudinal axis 211. Referring to FIG. 2, the outwardly facing surfaces 216 may include a plurality of surfaces including, among other surfaces, an upper facing surface 216*a*, a lower facing surface 216*b* (FIGS. 3A and 3B). In this implementation, the side surfaces of the intermediate portion 209 may contain a hole 206. Additional angled surfaces 216*c*, 216*d*, 216*e*, 216*f* (best seen in FIGS. 5 and 6), are disposed about the intermediate portion of the nose.

With reference to FIGS. 2, 3A, 3B, 5, and 6, the upper facing surface 216*a* of the intermediate portion 209 may extend at an angle different than both the adjacent upper surface 204*e* of the rear portion 207 and the adjacent top surface 202*e* of the front portion 205. Accordingly, the upper facing surface 216*a* may be non-planar with the adjacent upper surface 204*e* of the rear portion 207 and non-planar with the adjacent top surface 202*e* of the front portion 205. In a similar manner, the lower facing surface 216*b* of the intermediate portion 209 may extend at an angle different than both the adjacent bottom surface 204*g* of the rear portion 207 and the bottom surface 202*g* of the front portion 205.

In the present example, the top surface 204*e* includes a concave bearing surface 210 positioned thereon. In some examples, the top surface 204*e* circumscribes the concave bearing surface 210. In some implementations, the concave bearing surface 210 bridges the intersection of the upper facing surface 216*a* and the top surface 204*e*. The concave bearing surface 210, in this implementation, is an indentation that may cooperate with a corresponding protrusion on the wear member 104 to provide load bearing stability as well as lateral stability. While not seen from this perspective view, the nose 203 may also have a similar concave bearing surface portion on the bottom surface that is opposite the top surface 204*e*. In some implementations, the concave bearing surface on the bottom surface may be shaped identically to the concave bearing surface 210 on the top surface 204*e*. In the present example, the concave bearing surface 210 is substantially elliptical in shape. Other shapes are contemplated as well. For example, instead of being elliptical in shape, the concave bearing surface 210 may be circular or may have some other configuration.

The nose 203 also includes a hole 206 that extends from the side surface 204*h* to the opposing side surface (not shown in this perspective). In this implementation, the hole 206 is formed in the intermediate portion 209 of the nose 203. The hole 206 is sized and shaped to receive a locking pin. In the present example, the hole 206 is positioned forward of the concave bearing surface 210. In other words, at least a portion of the concave bearing surface 210 is positioned rearward of the hole 206. In some examples, the entire concave bearing surface 210 may be positioned rearward of the hole 206. In other implementations, the hole 206 extends only partially through the nose 203. A corresponding hole 206 may be formed in the opposing side of the nose 203. In these implementations, two separate locking pins may be used to secure the wear member 104 to the adapter 102 (see FIG. 1).

Figure 6:
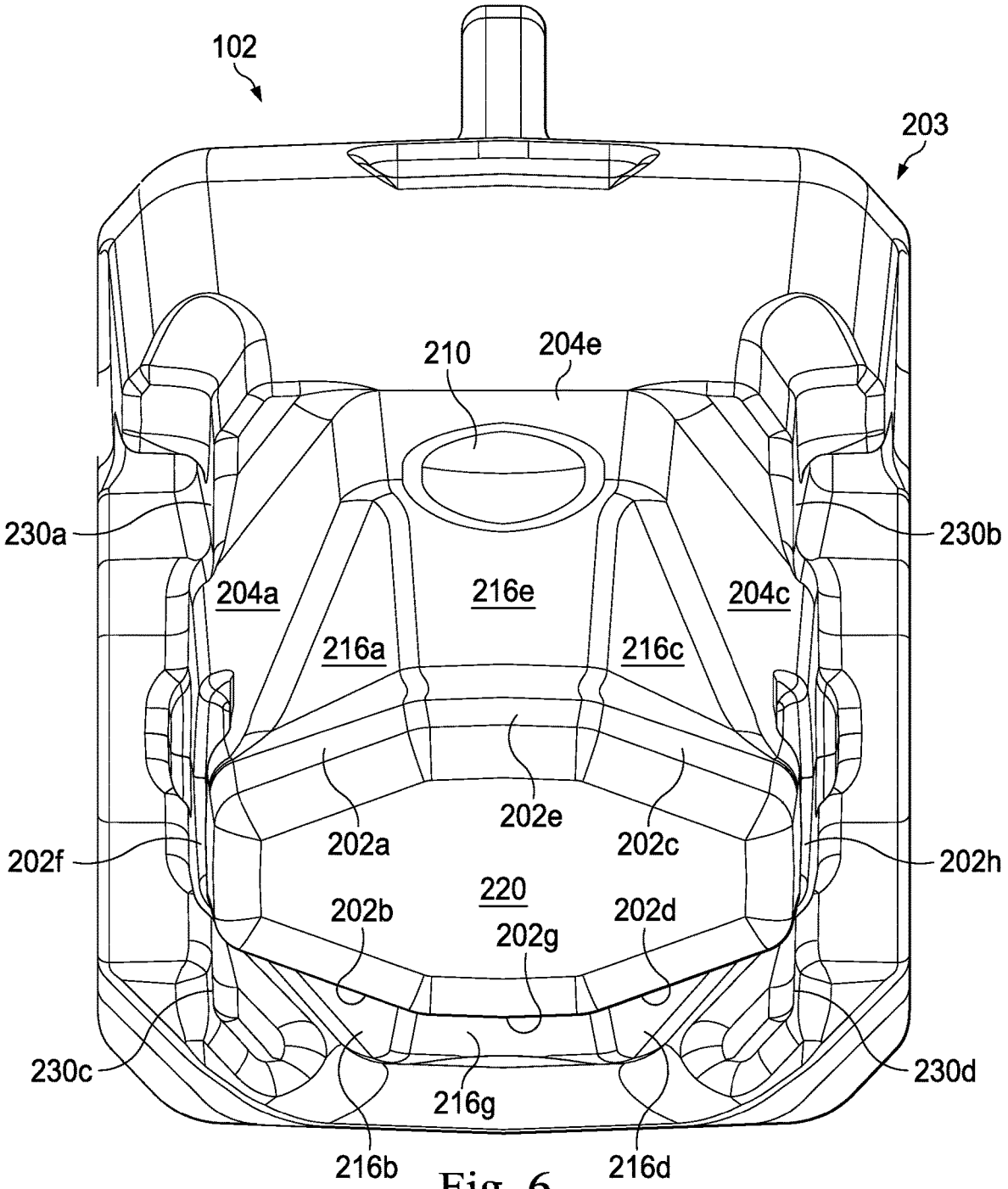
FIG. 6 is a front view of the nose with a bearing surface portion according to an example incorporating principles described herein.

The nose also includes torsion control surfaces 230*b*, 230*d*. Torsion control surfaces 230*a*, 230*c* are illustrated in FIGS. 4B and 6. The torsion control features 230*a*, 230*b*, 230*c*, and 230*d* may be substantially planar surfaces that are outward facing and are sized and shaped to fit against corresponding surfaces within the cavity of the tooth, which will be described in further detail below. In the present example, the torsion control surfaces 230*a*, 230*b*, 230*c*, 230*d* respectively intersect the angled surfaces 204*a*, 204*b*,

204*c*, 204*d* of the rear portion 207. Particularly, the torsion control surfaces 230*a*, 230*b*, 230*c*, 230*d* intersect the angled surfaces 204*a*, 204*b*, 204*c*, 204*d* near where such surfaces meet the vertical surfaces 204*f*, 204*h*. In some examples, the torsion control surfaces 230*a*, 230*b*, 230*c*, 230*d* may be flush with the vertical surfaces 204*f*, 204*h*.

In some examples, the angled surfaces of both the front surfaces 202 and the rear surfaces 204 may be bearing (or fit) surfaces. Specifically, surfaces 202*a*, 202*b*, 202*c*, 202*d*, 204*a*, 204*b*, 204*c*, 204*d* may be bearing surfaces. Additionally, the horizontal and top surfaces of the front surfaces 202 and the rear surfaces 204 may be non-bearing (or non-fit) surfaces. Specifically, surfaces 202*e*, 202*f*, 202*g*, 202*h*, 204*e*, 204*f*, 204*g*, 204*h* may be non-bearing surfaces. Other combinations of bearing and non-bearing surfaces are contemplated as well.

FIGS. 3A and 3B are diagrams showing longitudinal cross-sectional views of a portion of the adapter 102, showing the upper concave bearing surfaces 210 and a lower concave bearing surface 213. FIG. 3B in particular shows the bearing surface portion 213 in the bottom surface 204*g* of the nose of the adapter 102. In some embodiments, the top surface 204*e* and the bottom surface 204*g* may both be fit surfaces. In such a case, other surfaces, such as the side surfaces or angled surfaces may be either fit or non-fit surfaces. For example, it may be the case that all angled surfaces are non-fit surfaces while the top, bottom, and side surfaces are fit surfaces. As indicated above, some implementations of the concave bearing surface 210 bridge the intersection of the upper facing surface 216*a* and the top surface 204*e*. In such implementations, the upper facing surface 216*a* may be a non-fit surface, while the concave bearing surface 210 forms a fit surface. In some examples, the concave surfaces 210, 213 may be non-bearing surfaces. In such examples, various combinations of the horizontal, vertical, and angled surfaces may be fit surfaces, and in some instances, only the angled surfaces are fit surfaces. It may be the case that all surfaces are fit surfaces. Other combinations of fit and non-fit surfaces are contemplated. For example, the angled surfaces may be fit surfaces while the horizontal and vertical surfaces are non-fit surfaces in a manner similar to that described below in the text accompanying FIGS. 11A-16D.

The bottom concave bearing surface 213 may be substantially identical to the top concave bearing surface portion 210. In some examples, the position and shape of the bottom concave bearing surface portion 213 may mirror the position and shape of the top concave bearing surface portion 210. Accordingly, similar to the arrangement described above, the bottom concave bearing surface 213 may bridge the intersection of the lower facing surface 216*b* and the bottom surface 204*g*. In such implementations, the bottom facing surface 216*b* may be a non-fit surface, while the lower concave bearing surface 213 forms a fit surface. In some examples, the bottom concave bearing surface portion 213 may be longitudinally offset from the top concave bearing surface portion 210. For example, the bottom concave bearing surface portion 213 may be closer or farther from the front of the nose than the top concave bearing surface portion 210.

The concave bearing surface portions 210, 213 in this implementation are formed as indents that have smooth rounded surfaces as the shape transitions from the concave surface to the flat upper surface 204*e*. The indentation provides lateral stability to the rear of the wear member 104 when subjected to loading during use. In addition, when vertical loads are directed onto the leading tip of the wear member 104, the indentation distributes the load at the rear portion of the wear member and the load is transferred through the concave bearing surface portions 210, 213 to the adapter (or an intermediate adapter if so equipped). In addition, the load bearing concave surface portions 210, 213 provide a smooth surface, with curved sides that aid in lateral stability. Accordingly, lateral loads at the leading tip of the wear member 104 that result in opposite loads at the end of the wear member may be alleviated to some extent by the curved lateral sides of the concave bearing surface portions 210, 213. As can be seen, the indentations are formed on the top surface 204*e* that is longitudinally angled so as to face the leading end surface 220 of the adapter 102. Accordingly, corresponding protrusions on the inner surface of the wear member 104 may fit directly into the indented bearing surface portion 210 and 213.

Figure 4A:
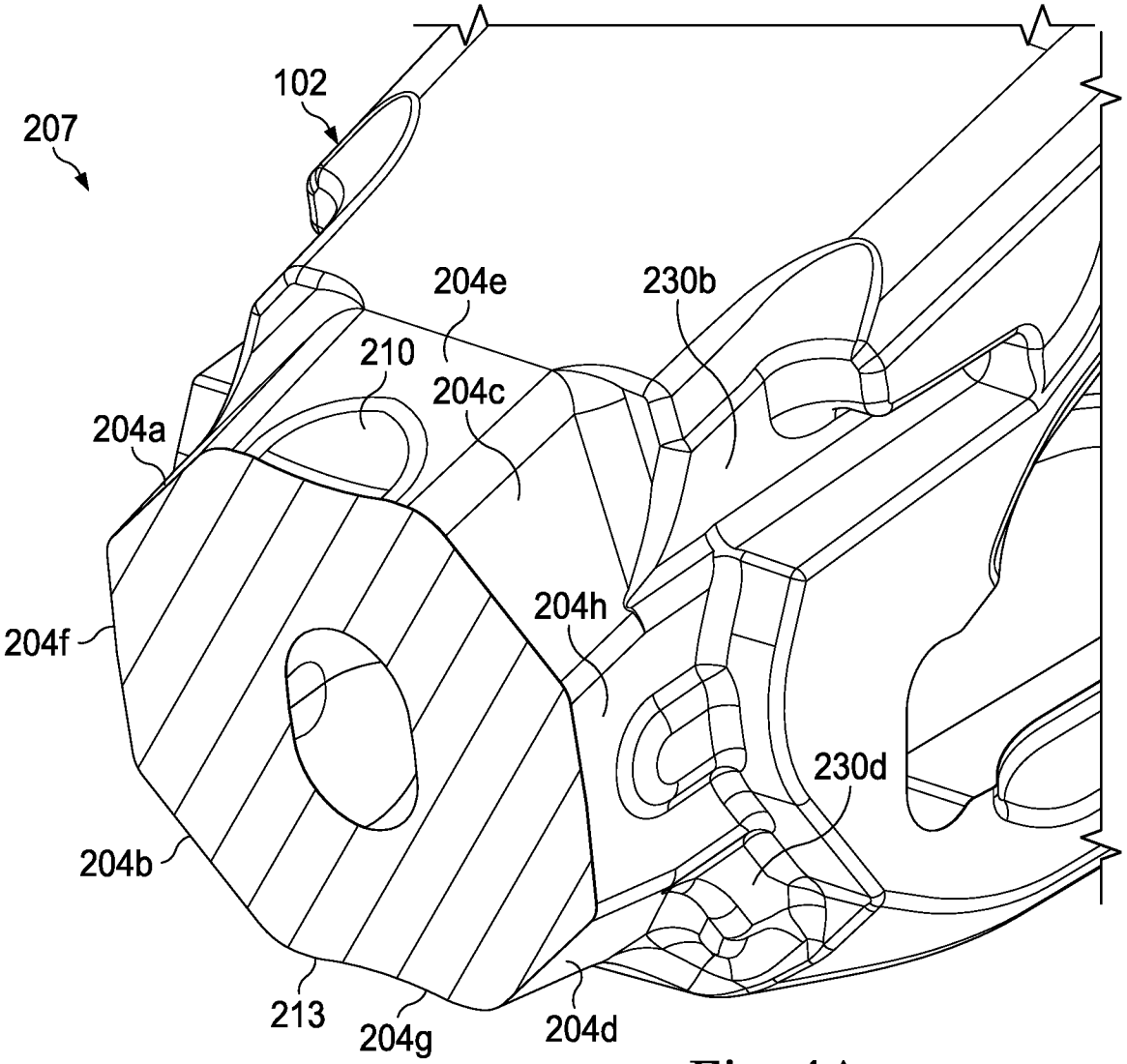
FIGS. 4A and 4B are diagrams showing transverse cross-sectional views of the bearing surface portion in the nose according to an example incorporating principles described herein.
Figure 4B:
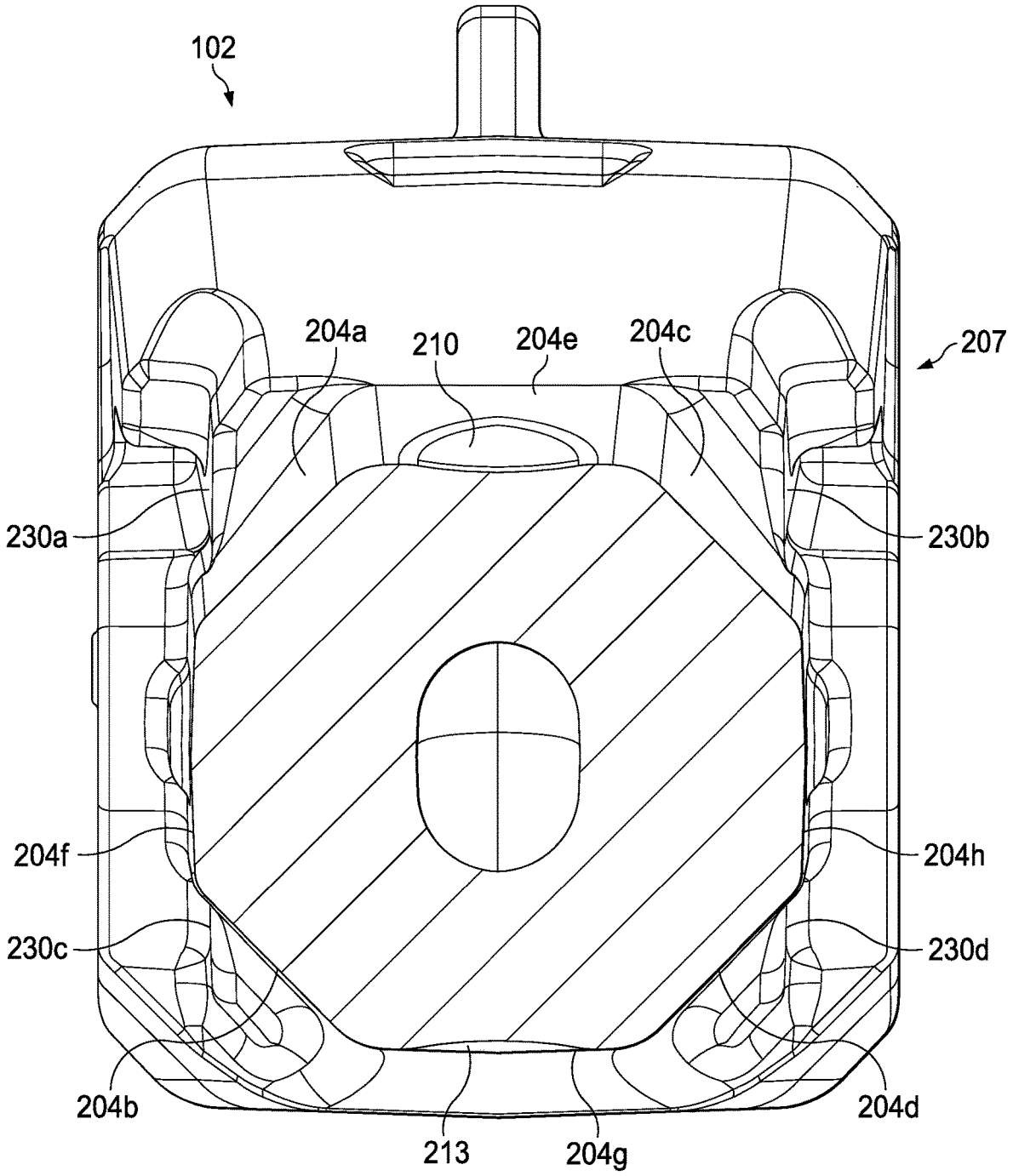

FIGS. 4A and 4B are diagrams showing transverse cross-sectional views of the concave bearing surface portions 210, 213 in the adapter 102. FIGS. 4A and 4B also show each of the rear surfaces 204. Specifically, FIGS. 4A and 4B illustrate upwardly facing top surface 204*e*, outwardly facing side surfaces 204*f*, 204*h*, and downwardly facing bottom surface 204*g*. FIGS. 4A and 4B also illustrate outwardly facing angled surfaces 204*a*, 204*b*, 204*c*, 204*d*. In the exemplary implementation shown, the concave bearing surface portions 210, 213 are formed in the rear portion 207 only in the upwardly facing top surface 204*e* and the downwardly facing bottom surface 204*g*, while the outwardly facing side surfaces 204*f*, 204*h* and the outwardly facing angled surfaces 204*a*, 204*b*, 204*c*, 204*d* are all formed to be relatively planar. This may provide additional fit surface support for vertical loading on a supported tooth 104, while providing standard support for horizontal or side to side loading.

Figure 5:
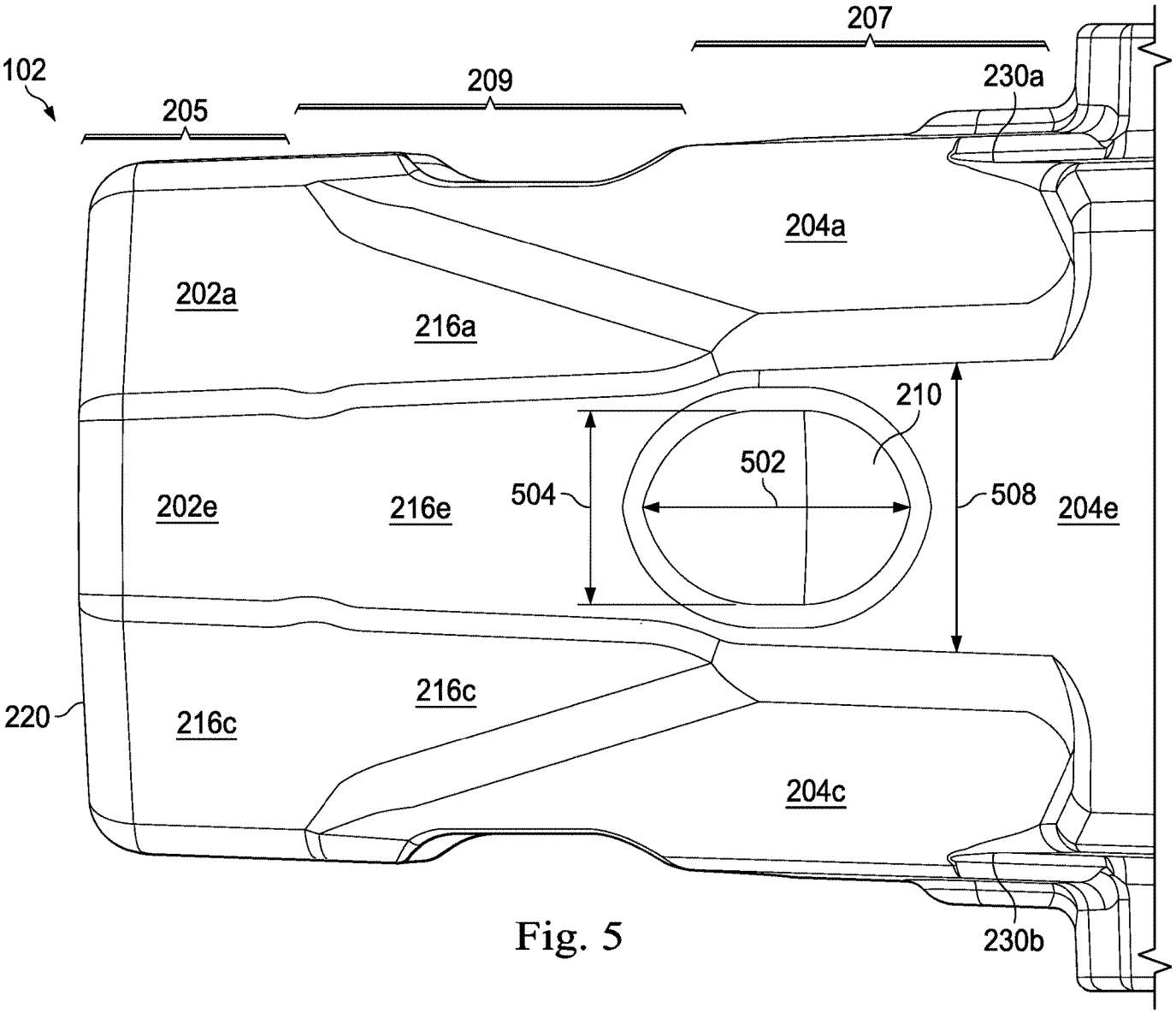
FIG. 5 is a top view of the nose with a bearing surface portion according to an example incorporating principles described herein.

FIG. 5 is a top view of the nose 203 of the adapter 102. The concave bearing surface portion 210 is shown extending into and across the intersection of the upper facing surface 216*a* and the top surface 204*e*. In some examples, the transverse width 504 of the concave bearing surface portion 210 may be within a range of about 60-80 percent of the transverse width 508 of the top surface 204*e*. In some examples, the transverse width 504 of the concave bearing surface portion 210 may be about 70% of the transverse width 508 of the top surface 204*e*. The longitudinal length 502 of the concave bearing surface portion 210 may be similar to the transverse width 504 of the concave bearing surface portion 210. In some examples, the longitudinal length 502 of the concave bearing surface portion 210 may be within a range of about 0-50 percent larger than the transverse width 504. The concave bearing surface portion 210 may be sized to provide stability and increase the surface area of the top surface 204*e* while minimizing weakening of the adapter 102 through stress risers. Accordingly, the depth of the indented bearing surface portion may be selected to provide the necessary balance of stability and strength. In some implementations, the depth of the bearing surface portion is selected to be within a range of about 0.1 inch to about 0.625 inch, although other depths are contemplated.

FIG. 6 is a front, slightly tilted view of the adapter 102 with the concave bearing surface portion 210. FIG. 6 also illustrates top surface 204*e* and top surface 202*e*, and the top surface 216*a*. FIG. 6 also illustrates rear angled surfaces 204*a*, 204*b*, front angled surfaces 202*a*, 202*b*, and intermediate non-bearing surfaces 216*c* and 216*f*.

Figure 7A:
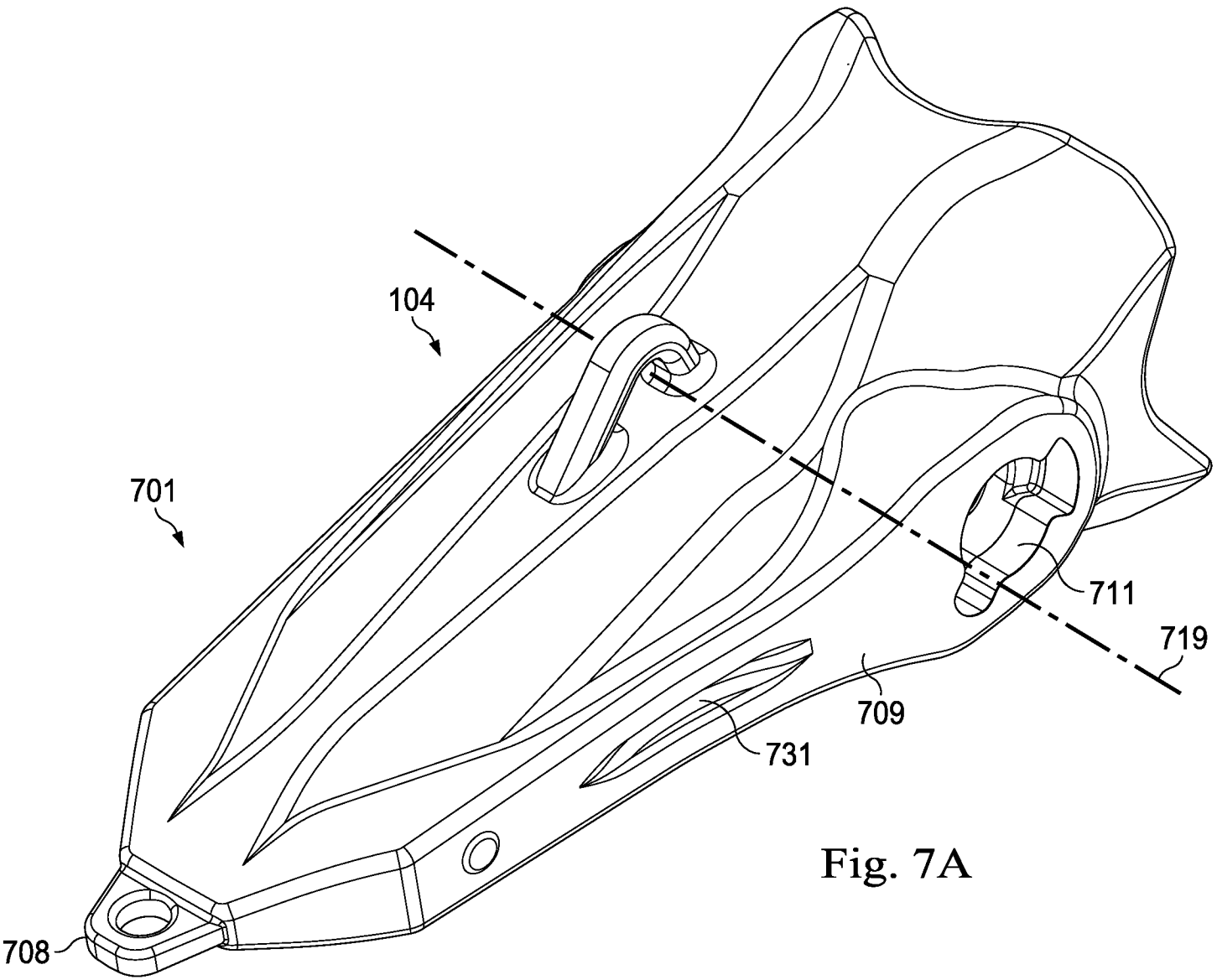
FIG. 7A is a perspective view of a tooth having a protrusion corresponding to the bearing surface portion in the nose according to an example incorporating principles described herein.

FIG. 7A is a perspective view of the wear member 104 that includes protrusions extending from inner surfaces of the cavity. The wear member 104 may also be referred to as a hollow ground-engaging wear member. Although the wear member 104 may also be referred to as a tooth, the wear member 104 may also form an intermediate adapter or other wear member configured to be supported by or to support other wear members. The wear member 104 includes a leading end 708 at the front end 701 of the wear member. The leading end 708 is arranged to engage or penetrate the ground, and may generally be referred to as the working end. The wear member 104 also includes a rear end, which has a cavity (shown in cross-section in FIG. 7B) that is sized and shaped to receive the nose 203 of the adapter 102.

In the present example, the side 709 of the wear member 104 includes a hole 711 that is sized and shaped to receive the locking pin 106 (FIG. 1). In some implementations, the opposing side of the wear member 104 may include a similar hole. The hole 711 may be positioned such that when the wear member 104 is properly set on the nose 203, the hole 711 is aligned with the hole 206 of the adapter 102. Thus, the locking pin 106 may be inserted through both holes 206, 711 and set so as to hold the wear member 104 on the adapter 102.

In the present example, the wear member 104 includes a wear indicator 731. The wear indicator 731 may be a divot or indentation in the wear member 104 that indicates to an operator when the wear member 104 should be replaced. Specifically, the wear member 104 wears as it is used for digging operations. When it wears to a point where the bottom of the wear indicator 731 is flush with the rest of the wear member 104, then this indicates to an operator that it is time to replace the wear member 104. The wear indicator 731 may be sized and shaped so that it has a depth associated with an expected amount of wear before the wear member 104 should be replaced. This expected amount of wear may be based on historical data that represents the manner in which the wear member 104 wears during normal operations. The wear indicator 731 may be positioned in other places on the wear member 104 as well.

Figure 7B:
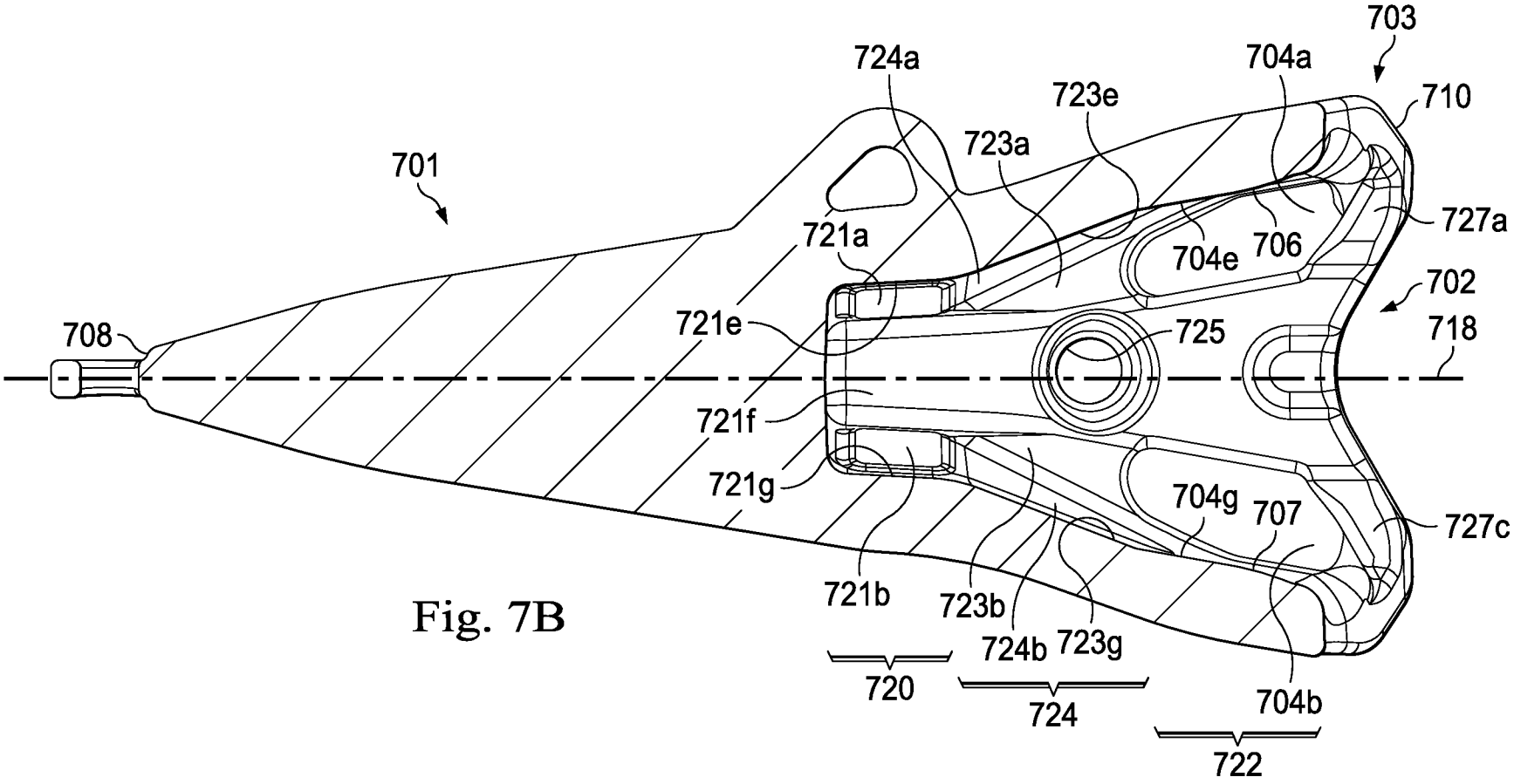
FIG. 7B is a longitudinal cross-sectional view of the tooth with the protrusion according to an example incorporating principles described herein.

FIG. 7B is a longitudinal cross-sectional view of the wear member 104 showing an upper protrusion 706 and a lower protrusion 707 arranged to correspond to the concave bearing surfaces 210, 213 on the adapter 102. The wear member 104 includes the leading end 708 and a rear end 703. A cavity 702 is formed in the rear end 703, extending longitudinally inward from the rear end 703. The cavity 702 opens to the rear of the wear member 104 and is shaped and sized to fit over the nose 203 of the adapter 102.

In some implementations, the cavity 702 is shaped to have surfaces corresponding with the various surfaces of the nose 203. In some implementations, since not all surfaces are fit surfaces, only the fit surfaces of the cavity 702 and the nose 203 have the same shape. That is, the cavity 702 may be contoured so that fit surfaces of the cavity 702 match fit surfaces of the adapter 102. Because of this, the descriptions applied herein relating to outer surfaces of the nose 203 are equally applicable to inner surfaces of the cavity 702 of the wear member 104. Similar to the nose 203, the cavity 702 includes a front portion 720, a rear portion 722, and an intermediate portion 724. The cavity 702 also includes a longitudinal axis 718 that in this implementation is coaxial with the longitudinal axis of the wear member 104. A transverse axis 719 (FIGS. 7A and 10) extends perpendicular to the longitudinal axis 718 and is arranged to lie substantially parallel to a leading end of a bucket lip.

According to the present example, the cavity 702 includes a front portion 720, an intermediate portion 724, and a rear portion 722. The front portion 720 includes a plurality of substantially planar inwardly facing surfaces 721*a*, 721*b*, 721*e*, 721*f*, 721*g* in an octagonal shape (not all eight surfaces are shown in the cross-sectional view of FIG. 7B). These surfaces 721*a*, 721*b*, 721*e*, 721*f*, 721*g* may correspond to some of the outwardly facing surfaces 202 of the front portion 205 of the adapter 102. As described above, some surfaces 202 of the front portion 205 may be fit surfaces while some may be non-fit surfaces. The fit surfaces of the adapter 102 may fit with the fit surfaces of the cavity 702 while the non-fit surfaces of the adapter 102 may have slightly different shapes than the non-fit surfaces of the cavity 702 or may be offset from the non-fit surfaces of the cavity 702.

The intermediate portion 724 includes a plurality of substantially planar inwardly facing surfaces 723*a*, 723*b*, 723*e*, 723*f*, 723*g* (not all surfaces are shown in the cross-sectional view of FIG. 7B). These surfaces 723*a*, 723*b*, 723*e*, 723*f*, 723*g* may correspond to some of the outwardly facing surfaces 216 of the intermediate portion 209 of the adapter 102. Specifically, the fit surfaces of the adapter 102 may fit with the fit surfaces of the cavity 702 while the non-fit surfaces of the adapter 102 may have slightly different shapes than the non-fit surfaces of the cavity 702 or may be offset from the non-fit surfaces of the cavity 702.

The rear portion 722 includes a plurality of substantially planar inwardly facing surfaces 704*a*, 704*b*, 704*c*, 704*d*, 704*e*, 704*f*, 704*g* 704*h* in an octagonal shape (some surfaces are better shown in FIGS. 8A and 8B). These surfaces include an upper inner surface 704*e* and a lower inner surface 704*g* (which are vertically separated, horizontally separated side surfaces 704*f*, 704*h*, upper angled inner surfaces 704*a*, 704*c*, and lower angled inner surfaces 704*b*, 704*g*. These surfaces 704*a*, 704*b*, 704*c*, 704*d*, 704*e*, 704*f*, 704*g* 704*h* may correspond to the outwardly facing surfaces 204 of the front portion 207 of the adapter 102. Specifically, the fit surfaces of the adapter 102 may fit with the fit surfaces of the cavity 702 while the non-fit surfaces of the adapter 102 may have slightly different shapes than the non-fit surfaces of the cavity 702 or may be offset from the non-fit surfaces of the cavity 702.

The cavity 702 includes an upper inward facing surface 704*e* that is designed to fit with the upward facing surface 204*e* of the nose 203. In some implementations, the upper inward facing surface 204*e* may be substantially planar. The upper inward facing surface 704*e* also includes an upper protrusion 706 extending therefrom. The upper protrusion 706 may also be described as an inwardly protruding bearing surface portion 706 since it protrudes inwardly toward a longitudinal axis 718 of the wear member 104 and the cavity 702. The upper inwardly protruding bearing surface portion 706 is sized and shaped to fit with the concave bearing surface portion 210 of the nose 203. Similarly, the cavity includes a lower inward facing surface 704*g* that is designed to fit with the downward facing surface 204*g* of the nose 203. The lower inward facing surface 704*g* also includes an inwardly protruding bearing surface portion 707. The cavity also includes other surfaces that correspond to the surfaces 202, 204 of the nose 203. The inwardly bearing surface portions 706, 707 are convex and are arranged to support vertically imposed loads at the leading end.

The protrusions 706, 707 may be centrally located on their respective surfaces 704*e*, 704*g*. Thus, the protrusions 706, 707 may be circumscribed by planar portions of surfaces 704*e*, 704*g*. Additionally, the protrusions 706, 707 may be laterally offset from each other if the corresponding concave bearing surface portions 210, 213 of the nose 203 are offset from each other. Both the upper protrusion 706 and the lower protrusion 706 may form a cross-sectional arc having tangents at oblique angles. In some examples, there may be only a single protrusion 706 on the upper surface 704 and only a single protrusion 707 on the lower surface 704*g*. In some examples, however, there may be additional protrusions on each surface 704*e*, 704*g*.

In the present example, the surfaces of the protrusions 706, 707 may act as bearing surfaces against the bearing surface portions 210, 213 of the adapter nose 203. Thus, the interference features that comprise the protrusions 706, 707 and the bearing surface portions 210, 213 may provide additional support for loads in various directions. Furthermore, by their curved nature, the protrusions and indentations provide lateral stability as well as act as vertical bearing surfaces.

The cavity 702 may also include a hole 725 that aligns with hole 206 when the wear member 104 is placed on the adapter 102. Such alignment allows for the locking pin to be inserted therethrough. In some examples, the wear member 104 may include a single hole on one side of the cavity and in some examples, the wear member 104 may include two holes, one on each side of the cavity 702.

Figure 10:
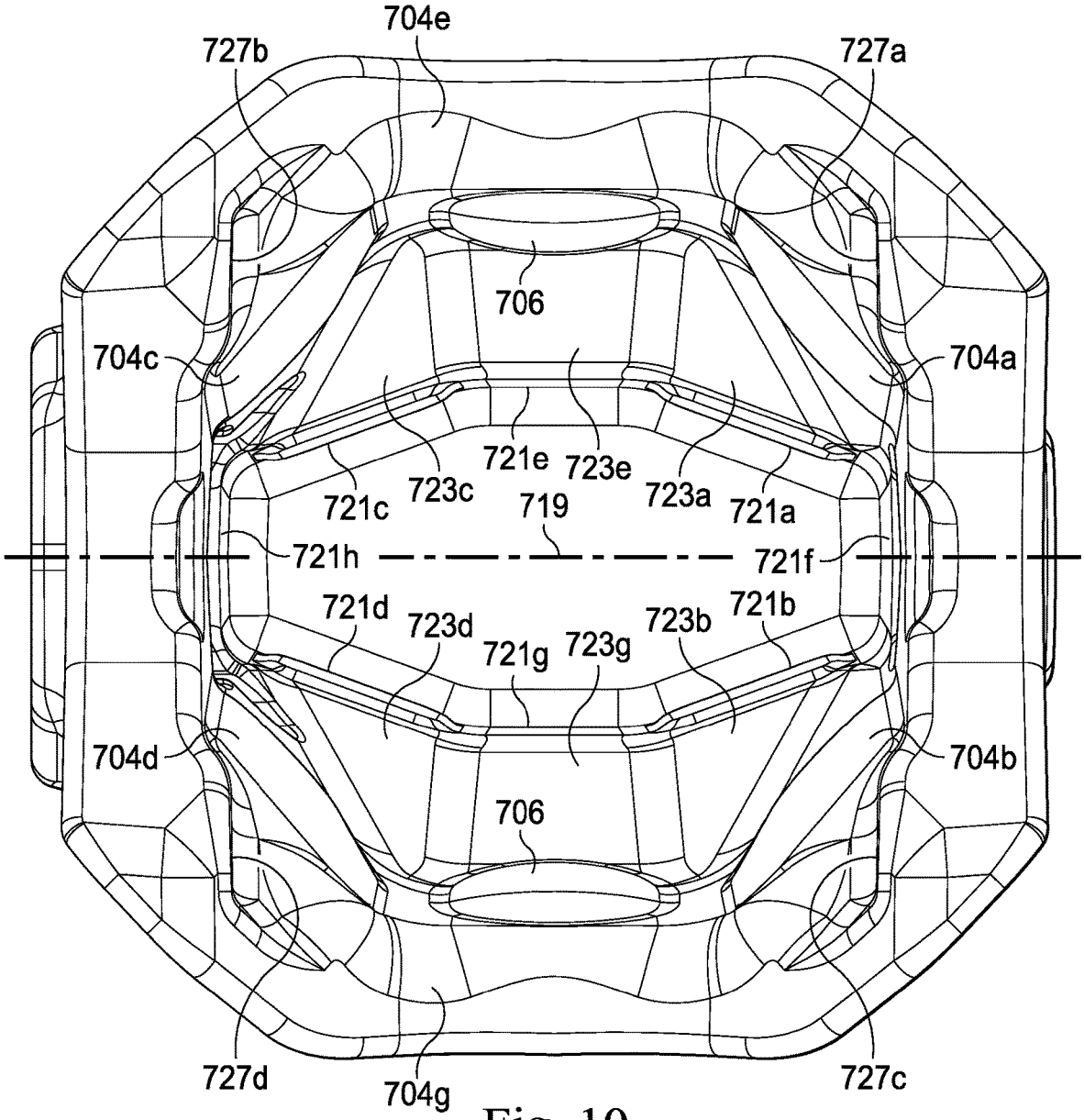
FIG. 10 is a rear view of the tooth looking into the cavity according to an example incorporating principles described herein.

The cavity 702 also includes inward facing torsion control surfaces 727*a*, 727*c*. Torsion control surfaces 727*h*, 727*d* are shown in FIG. 10. The inward facing torsion control surfaces 727*a*, 727*h*, 727*c*, 727*d* are sized and shaped to fit against the outward facing torsion control features 230*a*, 230*b*, 230*c*, 230*d* of the adapter nose.

Figure 8:
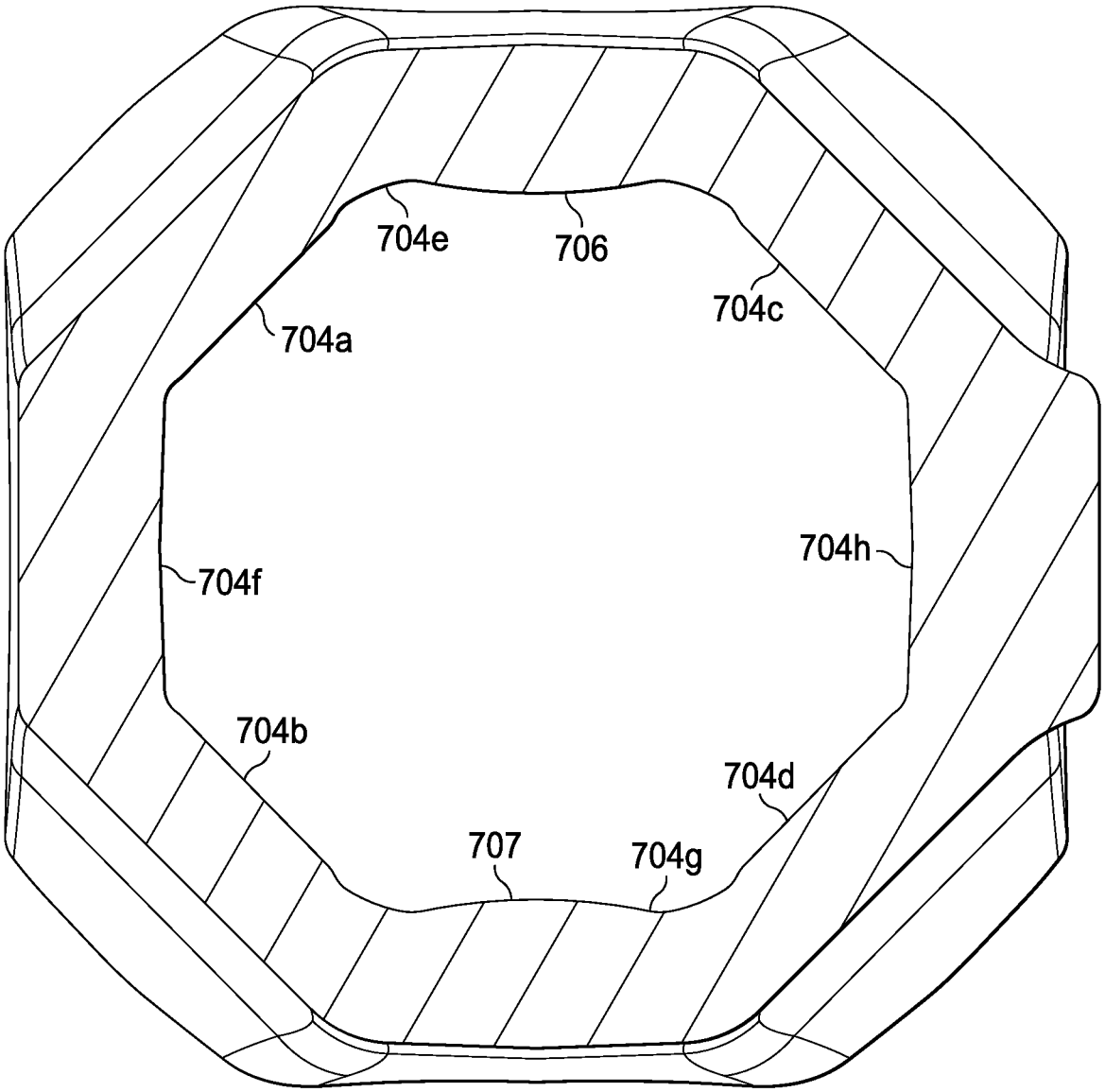
FIGS. 8 and 9 are transverse cross-sectional views of the tooth with the protrusion according to an example incorporating principles described herein.
Figure 9:
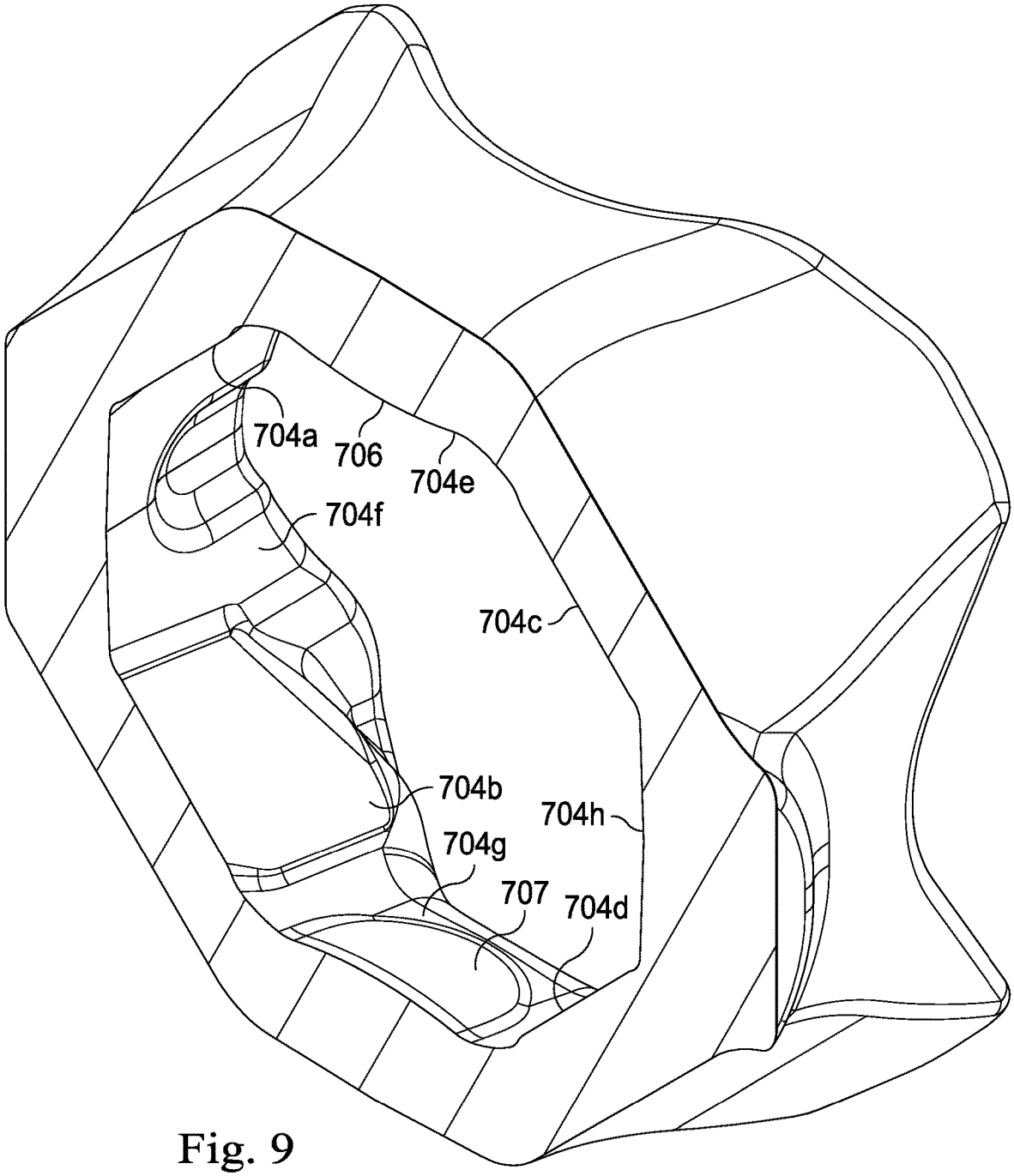

FIGS. 8 and 9 are transverse cross-sectional views of the tooth with the protrusion. FIG. 8 illustrates vertically separated opposing inner walls 704*e*, 704*g*, which correspond to walls 204*e*, 204*g* of the nose 203. FIG. 8 also illustrates horizontally separated opposing inner walls 704*f*, 804*h*, which correspond to walls 204*f*, 204*h* of the nose 203. FIG. 8 also illustrates the transversely angled inward facing walls 704*a*, 704*b*, 704*c*, 704*d* that correspond to outward facing transversely angled walls 204*a*, 204*b*, 204*c*, 204*d* of the nose 203.

FIG. 10 is a rear view of the tooth looking into the cavity 702. Looking into the cavity, the surfaces 721*a*, 721*b*, 721*c*, 721*d*, 721*e*, 721*f*, 721*g*, 721*h* of the front portion 720 of the cavity 702 can be seen. Additionally, the surfaces 723*a*, 723*b*, 723*c*, 723*d*, 723*e*, 723*f*, 723*g*, 723*h* of the intermediate portion 724 of the cavity 702 can be seen. Furthermore, surfaces 704*a*, 704*b*, 704*c*, 704*d*, 704*e*, 704*g* as well as the protrusions 706, 707 may be seen.

While the concave bearing surface portions 210, 213 and protrusions 706, 707 are substantially elliptical in shape, some embodiments may have polygonal shaped bearing surface portions and protrusions. In some examples, the bearing surface portions may be placed in the side surface near or adjacent the holes 206, 711 through which the lock pin is inserted. Because the protrusions 706, 707 are sized and shaped to match the size and shape of the concave bearing surface portions, the description of either one applies equally to the other.

Although the indentations are described on the adapter 102 and the protrusions are described on inner surfaces of the wear member 104, it should be noted that some implementations are oppositely arranged to have the protrusion on the adapter 102 and the indentations on the wear member 104.

The present disclosure is also directed to an earth engaging wear member assembly that includes an adapter nose securable to a bucket lip and a tooth. The nose includes angled bearing surfaces arranged to be received into a cavity of the tooth. The cavity includes bearing surfaces that correspond with and engage the bearing surfaces of the nose. According to some examples, the adapter nose may include a forward portion at the distal end of the nose and a rear portion at the proximal end of the nose. The rear portion may include eight substantially planar surfaces that converge towards the longitudinal axis of the nose. The forward portion also may include eight substantially planar surfaces that converge towards the longitudinal axis of the nose, but at a shallower angle. In some implementations, both the forward portion and the rear portion thus have substantially octagonal-shaped cross-sections. In some implementations, in the rear portion, the horizontal and vertical surfaces of the octagonal-shaped cross-section may be non-bearing surfaces and the angled surfaces (e.g., the non-horizontal and non-vertical surfaces) may be bearing surfaces. In the forward portion the angled surfaces may be bearing surfaces as well.

Figure 11A:
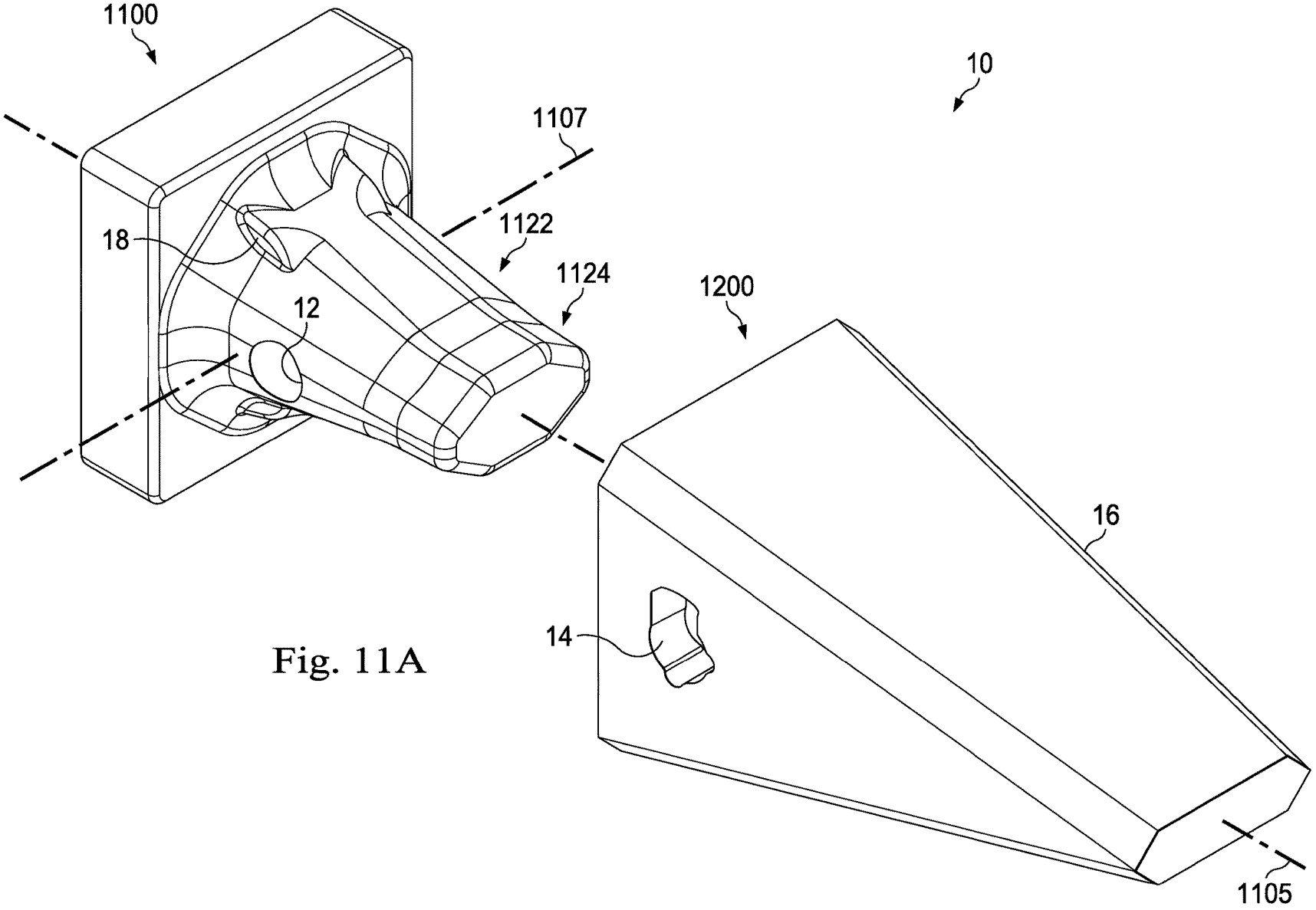
FIG. 11A is an exploded perspective view of an earth engaging wear member assembly according to one example of principles described herein.

FIG. 11A is an exploded perspective view of an earth engaging wear member assembly 10. According to the present example, the wear member assembly 10 includes a nose 1100 and a wear member 1200. An exemplary implementation of the wear member 1200 is a tooth 1200. In another implementation, the wear member 1200 is an intermediate adapter. Other wear members are contemplated. The nose 1100 includes a forward portion 1124 and a rear portion 1122. In the example shown, the nose 1100 extends from a base structure that is shown as a block but represents any additional attachment structure that make support the nose including a bucket receiving portion having bifurcated adapter legs, similar to the adapter 102 in FIG. 1. In some implementations, the nose is securable to a bucket lip of an excavator. The nose may form a part of an adapter or an intermediate adapter, and may also be referred to herein as a support structure since it provides stabilizing support to an additional component, which in this implementation is the tooth 1200. The nose 1100 also includes a hole 12 for receiving a locking pin. In the present example, the nose includes torsion control features 18. The tooth 1200 also includes a hole 14 through which the locking pin can be inserted. Since any of a number of known locking pins may be employed here, details of the locking pin are not included. The tooth 1200 also includes a rear facing cavity (not shown in FIG. 11A) and a ground engaging end as a leading end 16. An axis 1105 extends through the wear member assembly 10.

Figure 11B:
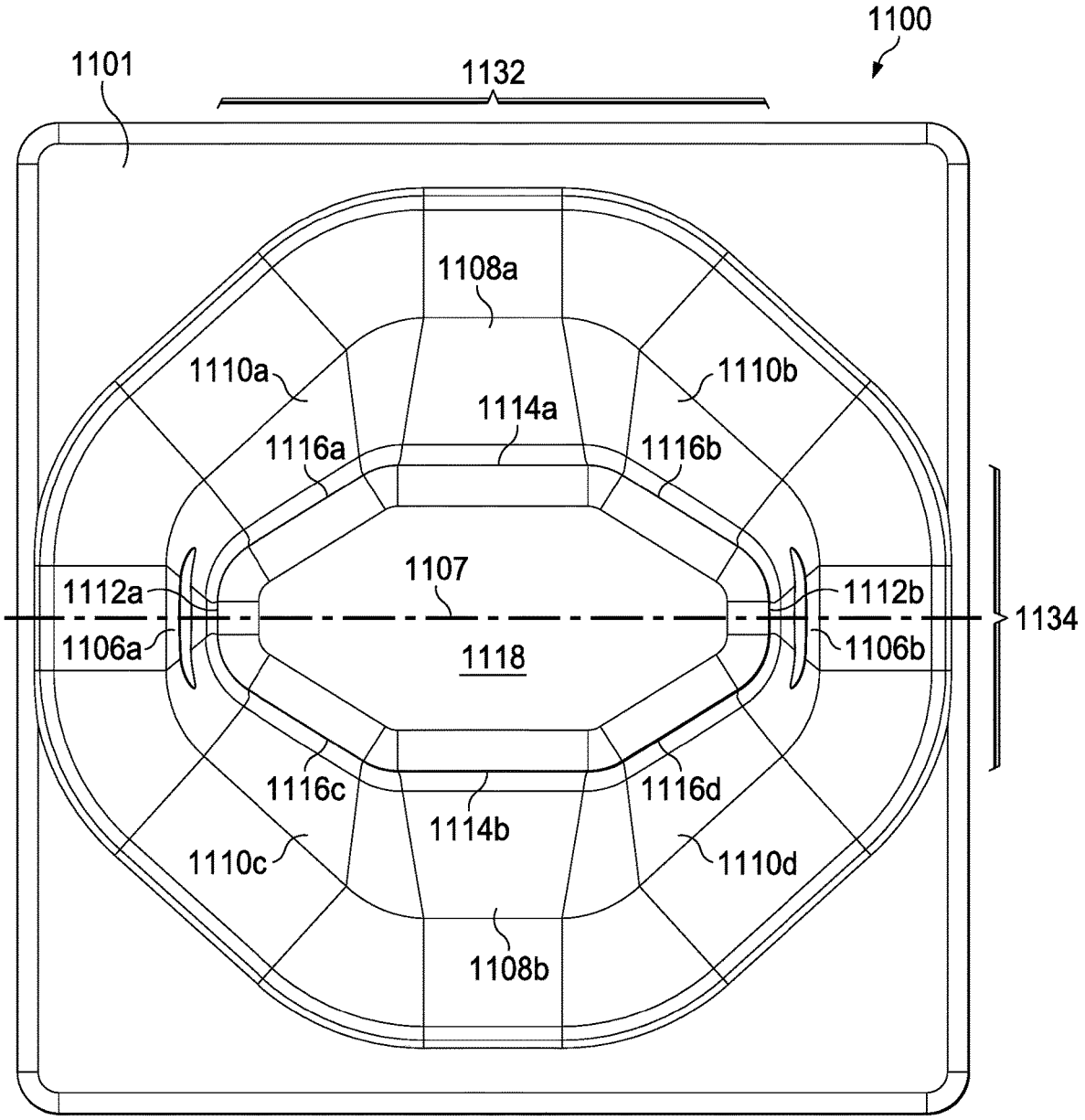
FIG. 11B illustrates an adapter nose looking along the longitudinal axis of the nose according to one example of principles described herein.
Figure 11C:
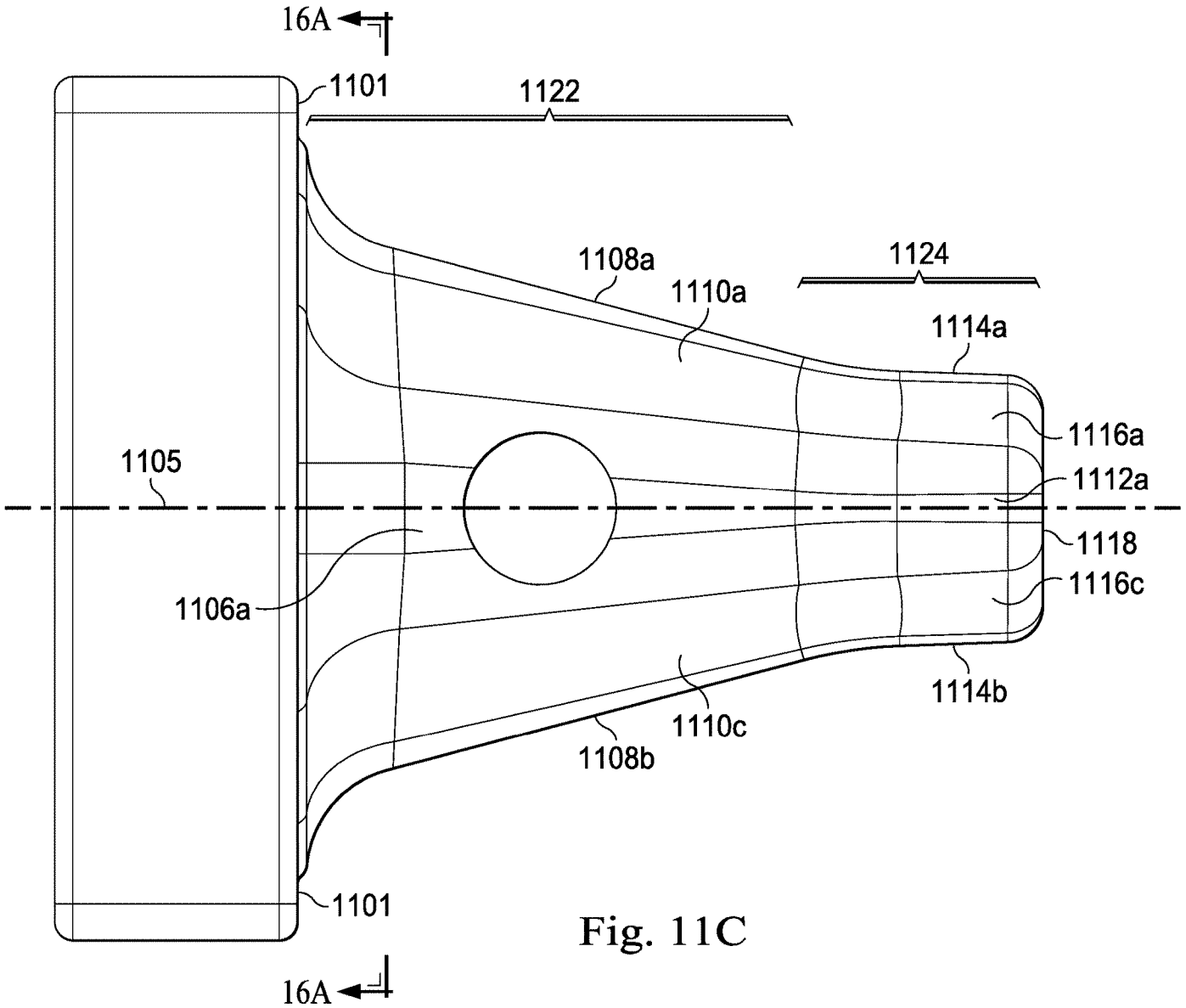
FIG. 11C illustrates a side view of the adapter nose according to one example of principles described herein.

FIG. 11B shows a view of the nose 1100 looking along the longitudinal axis 1105 of the nose 1100. FIG. 11C shows a side view of the nose 1100, looking along a transverse axis 1107. The transverse axis 1107 is aligned in a position that would run parallel to an edge of the bucket lip (not shown). As described above, the nose 1100 may be secured to a bucket lip and includes a forward portion 1124 and a rear portion 1122. The rear portion 1122 includes a set of eight substantially planar surfaces. Particularly the set includes a subset having a top surface 1108*a* and a bottom surface 1108*b*, a subset of two side surfaces 1106*a*, 1106*b*, and a subset of four angled surfaces 1110*a*, 1110*b*, 1110*c*, 1110*d*. The top and bottom surfaces may be referred to as horizontal surfaces and the side surfaces may be referred to as vertical surfaces because such surfaces are horizontal and vertical in cross-section. The four angled surfaces 1110*a*, 1110*b*, 1110*c*, 1110*d* may be bearing surfaces arranged to contact and interface with surfaces of the tooth 1200. Because each bearing surface is angled, each bearing surface is able to resist both horizontal and vertical loading. The angled surfaces may also be referred to as diagonal or oblique surfaces. Both the horizontal surfaces 1108*a*, 1108*b* and the vertical surfaces 1106*a*, 1106*b* may be non-bearing surfaces.

In this exemplary implementation, each of the eight substantially planar surfaces converges towards the longitudinal axis 1105 of the nose 1100. In some examples, the angle of the eight substantially planar surfaces with respect to the longitudinal axis 1105 may be within a range of about 5-25 degrees. In some examples, the angle may be within a range of about 8-15 degrees. Other ranges are contemplated as well. In this implementation, the top and bottom surfaces 1108*a*, 1108*b* may be wider than the side surfaces 1106*a*, 1106*b*. Thus, the octagon-shaped cross-section may be different in width 1132 than in height 1134. This helps with torsion control and stability.

In the exemplary implementation shown, the forward portion 1124 also includes a set of eight substantially planar surfaces. Particularly the set includes a subset having a top surface 1114*a* and a bottom surface 1114*b*, a subset of two side surfaces 1112*a*, 1112*b*, and a subset of four angled surfaces 1116*a*, 1116*b*, 1116*c*, 1116*d*. The four angled surfaces 1116*a*, 1116*b*, 1116*c*, 1116*d* may be bearing surfaces arranged to contact and interface with surfaces of the tooth 1200. Because each bearing surface is angled, each bearing surface is able to resist both horizontal and vertical loading. The top and bottom surfaces 1114*a*, 1114*b* may also be non-bearing surfaces. In some examples, the side surfaces 1112*a*, 1112*b* may be bearing surfaces. In some examples, however, the side surfaces 1112*a*, 1112*b* may be non-bearing surfaces. In some implementations, the non-bearing surfaces of the front portion or 1124 or the rear portion 1122 may not be substantially planar.

In some implementations, each of the eight substantially planar surfaces of the forward portion 1124 converges towards the longitudinal axis 1105 of the nose 1100 but at an angle that is shallower than the angle at which the eight substantially planar surfaces of the rear portion 1122 converge towards the longitudinal axis 1105. In some examples, the angle of the eight substantially planar surfaces of the forward portion 1124 with respect to the longitudinal axis 1105 may be within a range of about 0-15 degrees. In some examples, the angle may be within a range of about 1-8 degrees. Additionally, the top and bottom surfaces 1114*a*, 1114*b* may be wider than the side services 1112*a*, 1112*b*. Thus, the octagon-shaped cross-section is different in width 1132 than it is in height 1134. This also helps with stability and torsion control. In some examples, the ratio of top or bottom surface width to side surface width is different in the forward portion 1124 than it is in the rear portion 1122. For example, the ratio of top or bottom surface width to side surface width may be greater in the forward portion 1124 than it is in the rear portion 1122.

Figure 12A:
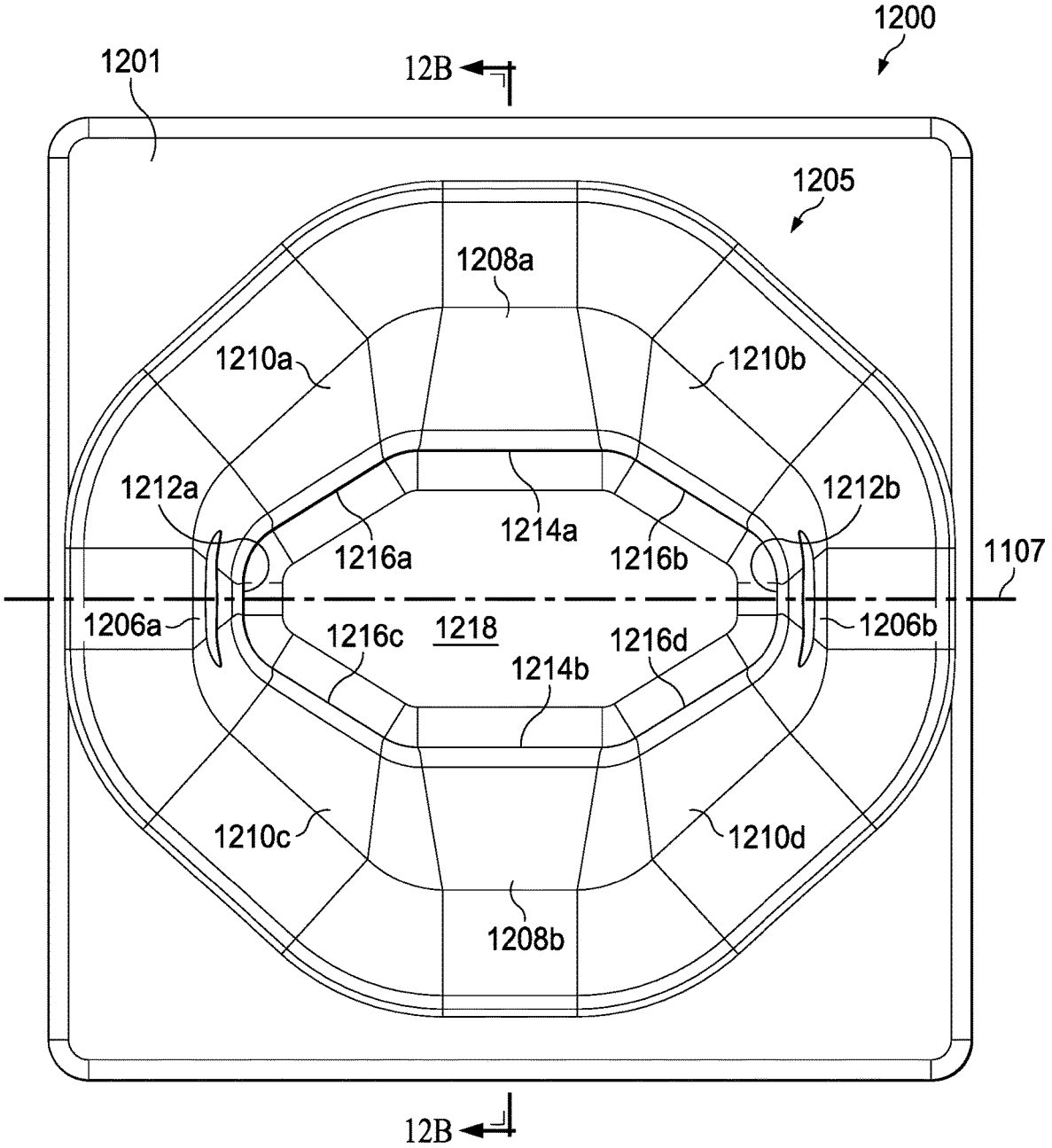
FIG. 12A illustrates the tooth looking into the cavity according to one example of principles described herein.
Figure 12B:
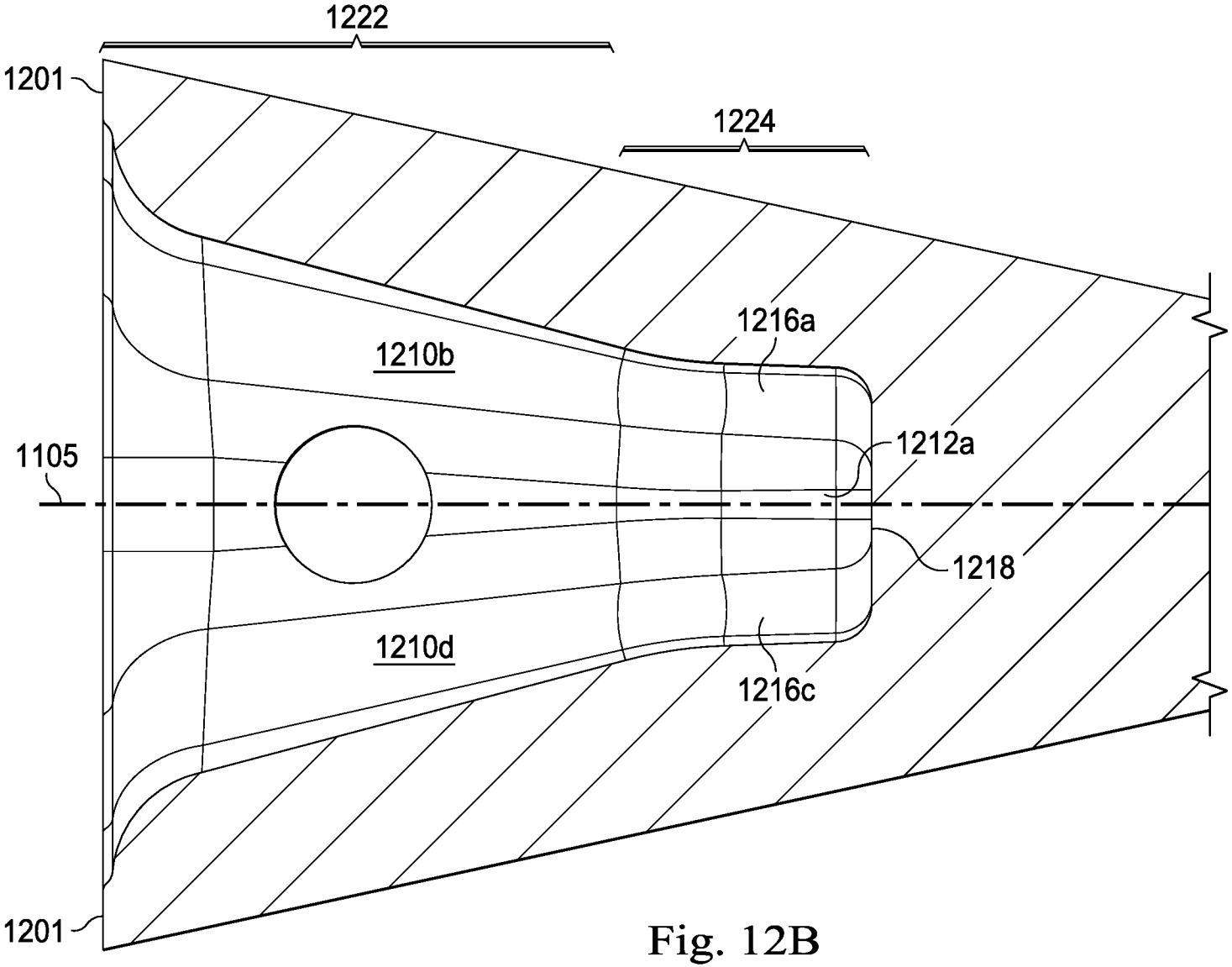
FIG. 12B illustrates a cross-sectional side view of the tooth assembly according to one example of principles described herein.

FIG. 12A shows a view of the tooth 1200 looking into the cavity 1205. FIG. 12B is a cross-sectional view of the tooth 1200 along the longitudinal axis 1105, taken along lines 12B-12B in FIG. 12A. The cavity 1205 is formed in the rear end 1209 of the tooth 1200, extending longitudinally inward from the rear end 1204. The cavity 1205 has bearing surfaces that correspond to and interface with the bearing surfaces of the nose 1100. It also has reference longitudinal axis 1105 and transverse axis 1107. The cavity 1205 also includes a front portion 1224 and a rear portion 1222. The rear portion 1222 includes a set of eight substantially planar surfaces. Accordingly, in this exemplary implementation, the set of substantially planar surfaces includes a subset of having a top surface 1208*a* and a bottom surface 1208*b*, a subset of two side surfaces 1206*a*, 1206*b*, and a subset of four angled surfaces 1210*a*, 1210*b*, 1210*c*, 1210*d*. The four angled surfaces 1210*a*, 1210*b*, 1210*c*, 1210*d* may be bearing surfaces. Because each bearing surface is angled, each bearing surface is able to resist both horizontal and vertical loading that may be applied to the tooth 1200 during use. Both the top and bottom surfaces 1208*a*, 1208*b* and the side surfaces 1206*a*, 1206*b* may be non-bearing surfaces. In some examples, the non-bearing surfaces may not be substantially planar. For example, the non-bearing surfaces may be curved.

The forward portion 1224 also includes a forward set of eight substantially planar surfaces. Particularly the forward set includes a subset having a top 1214*a* surface and a bottom surface 1214*b*, a subset of two side surfaces 1212*a*, 1212*b*, and a subset of four angled surfaces 1216*a*, 1216*b*, 1216*c*, 1216*d*. The four angled surfaces 1216*a*, 1216*b*, 1216*c*, 1216*d* may be bearing surfaces. Again, because each bearing surface is angled, each bearing surface is able to resist both horizontal and vertical loading. The horizontal surfaces 1214*a*, 1214*b* may also be non-bearing surfaces. In some examples, the vertical surfaces 1212*a*, 1212*b* may be bearing surfaces. In some examples, however, the vertical surfaces 1212*a*, 1212*b* may be non-bearing surfaces.

Referring now to FIG. 11C, the nose 1100 includes a rear surface 1101 and a front octagonal-shaped abutment surface 1118. The front abutment surface 1118 may have an octagonal shape. The front abutment surface 1118 may be a fit surface as it is designed to make contact with a front abutment surface 1218 of the cavity 1205 (shown in FIGS. 12A and 12B). The front abutment surface 1218 of the cavity 1205 may also have an octagonal shape. The rear surface 1201 at the rear end 1109 of the tooth 1200 may or may not make contact with the rear surface 1101 of the nose 1100.

In some implementations, the nose 1100 and the tooth 1200 may be designed symmetrically so that the tooth can be rotated 180 degrees and still fit appropriately on the tooth. This allows the tooth 1200 to be flipped after a certain period of wear. The tooth 1200 may then continue to be used in the flipped position. This extends the life of the tooth 1200.

Figure 13:
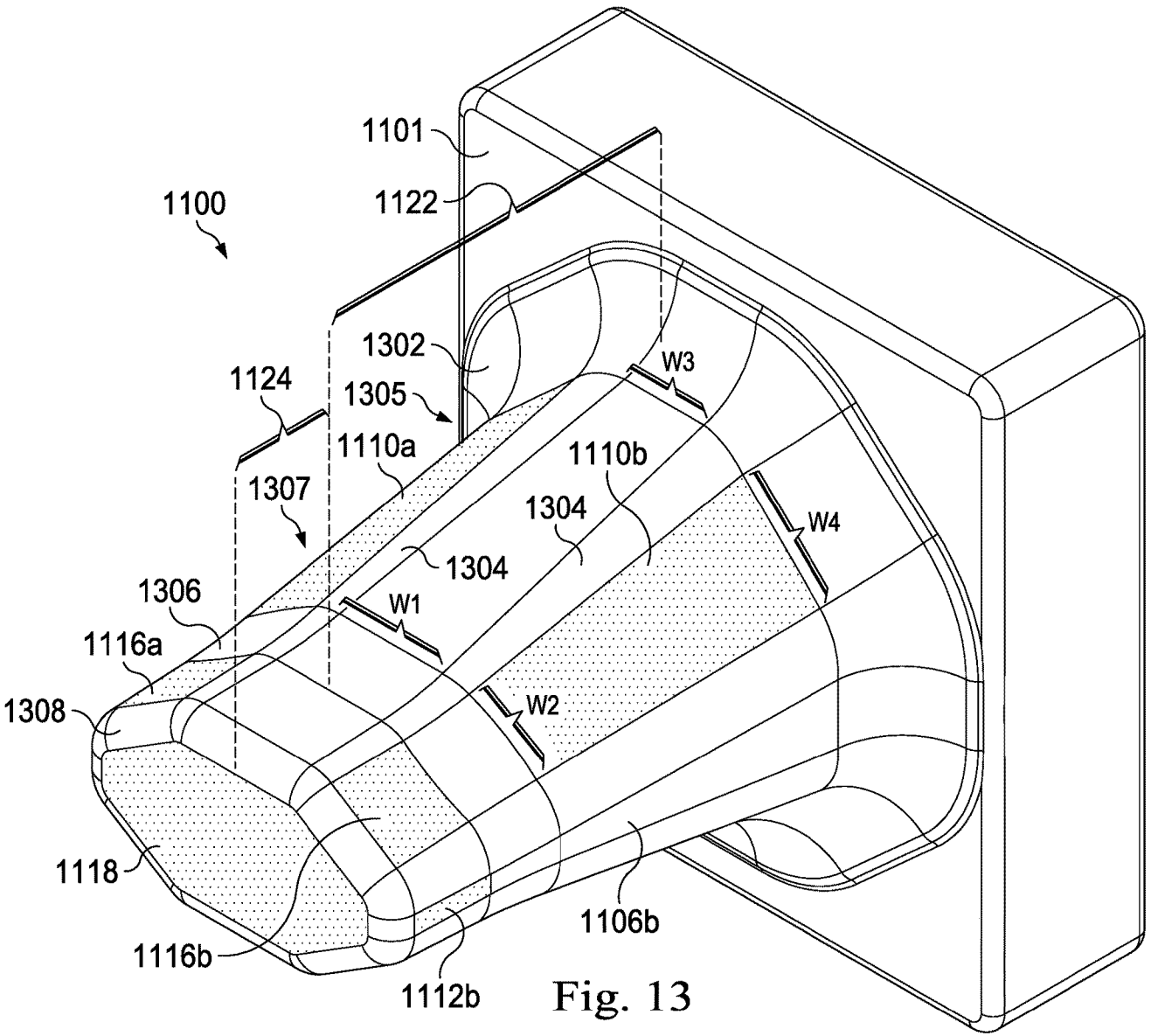
FIG. 13 illustrates a perspective view of the adapter nose according to one example of principles described herein.

FIG. 13 is a perspective view of the nose 1100. In addition to the substantially planar surfaces 1106*a*, 1106*b*, 1108*a*, 1108*b*, 1110*a*, 1110*b*, 1110*c*, 1110*d*, 1112*a*, 1112*b*, 1114*a*, 1114*b*, 1116*a*, 1116*b*, 1116*c*, 1116*d*, both the forward portion 1124 and the rear portion 1122 may have curved surfaces positioned between the planar surfaces. In implementations having the rear surface 1101, the nose 1100 may include surfaces 1302 disposed between and transitioning from the rear surface 1101 to the eight substantially planar surfaces 1106*a*, 1106*b*, 1108*a*, 1108*b*, 1110*a*, 1110*b*, 1110*c*, 1110*d* of the rear portion 1122. The nose 1100 may also include elongated curved surfaces 1304 between adjacent edges of each of the planar surfaces 1106*a*, 1106*b*, 1108*a*, 1108*b*, 1110*a*, 1110*b*, 1110*c*, 1110*d*, 1112*a*, 1112*b*, 1114*a*, 1114*b*, 1116*a*, 1116*b*, 1116*c*, 1116*d* in both the forward portion 1124 and the rear portion 1122. The nose 1100 may also include curved surfaces 1306 positioned between the planar surfaces 1106*a*, 1106*b*, 1108*a*, 1108*b*, 1110*a*, 1110*b*, 1110*c*, 1110*d* of the rear portion 1122 and the planar surfaces of the forward portion 1124. The nose 1100 may also include curved surfaces 1308 positioned between the front abutment surface 1118 and the planar surfaces 1112*a*, 1112*b*, 1114*a*, 1114*b*, 1116*a*, 1116*b*, 1116*c*, 1116*d* of the forward portion 1124. In some implementations, these curved surfaces may be fillets or rounds intended to minimize locational stress during use. The curved surfaces may also help provide clearance for the cavity of the wear member.

In some examples, the cross-sectional width W1 of the top and bottom non-bearing surfaces 1108*a*, 1108*b* is different at the distal end 1307 of the rear portion 1122 than the cross-sectional width W3 at the proximal end 1305 of the rear portion 1122. For example, the cross-sectional width W1 of the top and bottom non-bearing surfaces 1108*a*, 1108*b* may be smaller at the distal end 1307 of the rear portion 1122 than the cross-sectional width W3 at the proximal end 1305 of the rear portion 1122 or vice versa. Furthermore, the cross-sectional width W2 of the bearing surfaces 1110*a*, 1110*b*, 1110*c*, and 1110*d* at the distal end 1307 of the rear portion 1122 may be different than the cross-sectional width W4 at the proximal end 1305. For example, the cross-sectional width W2 of the bearing surfaces 1110*a*, 1110*b*, 1110*c*, and 1110*d* at the distal end 1307 of the rear portion 1122 may be smaller than the cross-sectional width W4 at the proximal end 1305 or vice versa. Furthermore, the cross-sectional width W1 of the top and bottom surfaces 1108*a*, 1108*b* at the distal end 1307 of the rear portion 1122 may be different than the cross-sectional width W2 of the bearing surfaces 1110*a*, 1110*b*, 1110*c*, 1110*d* at the distal end 1307 of the rear portion 1122. For example, the cross-sectional width W1 of the top and bottom surfaces 1108*a*, 1108*b* at the distal end 1307 of the rear portion 1122 may be smaller than the cross-sectional width W2 of the bearing surfaces 1110*a*, 1110*b*, 1110*c*, 1110*d* at the distal end 1307 of the rear portion 1122 or vice versa. Furthermore, the cross-sectional width W3 of the top and bottom surfaces 1108*a*, 1108*b* at the proximal 1305 end of the rear portion 1122 may be different than the cross-sectional width W4 of the bearing surfaces 1110*a*, 1110*b*, 1110*c*, 1110*d* at the proximal end 1305 of the rear portion 1122. For example, the cross-sectional width W3 of the top and bottom surfaces 1108*a*, 1108*b* at the proximal 1305 end of the rear portion 1122 may be greater than the cross-sectional width W4 of the bearing surfaces 1110*a*, 1110*b*, 1110*c*, 1110*d* at the proximal end 1305 of the rear portion 1122 or vice versa.

Figure 14A:
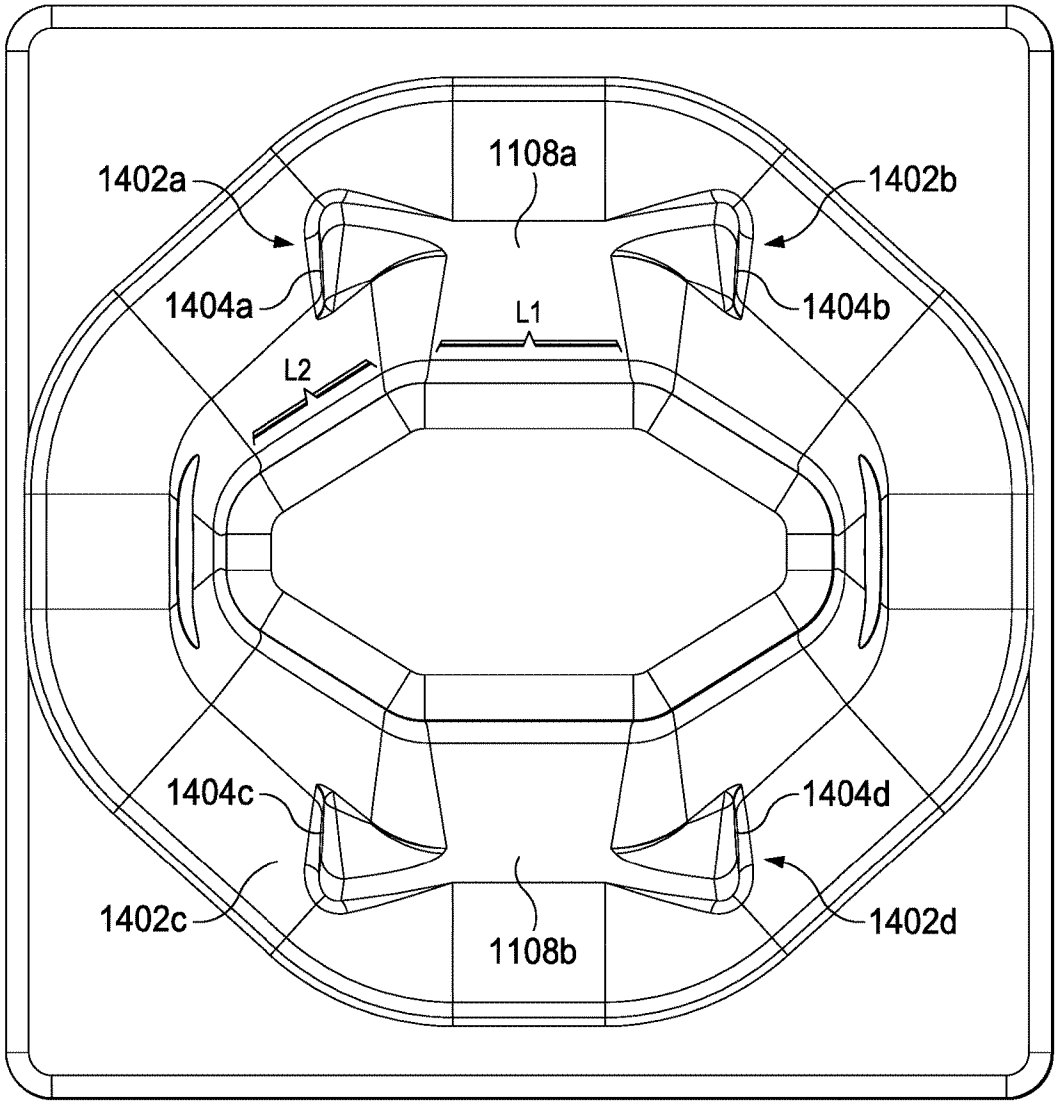
FIG. 14A illustrates an adapter nose with torsion control features according to one example of principles described herein.
Figure 14B:
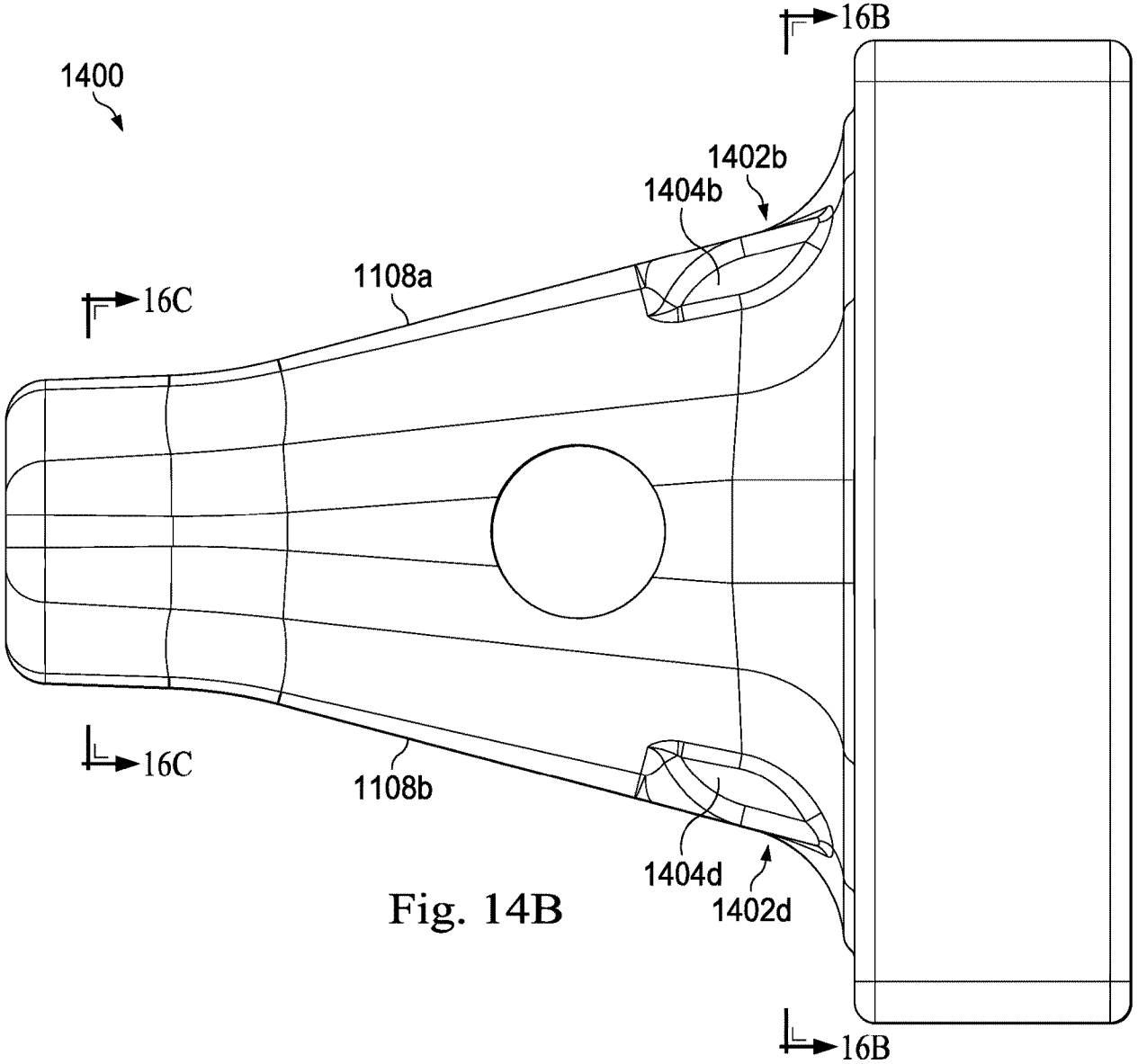
FIG. 14B illustrates a side view of an adapter nose with torsion control features according to one example of principles described herein.
Figure 14C:
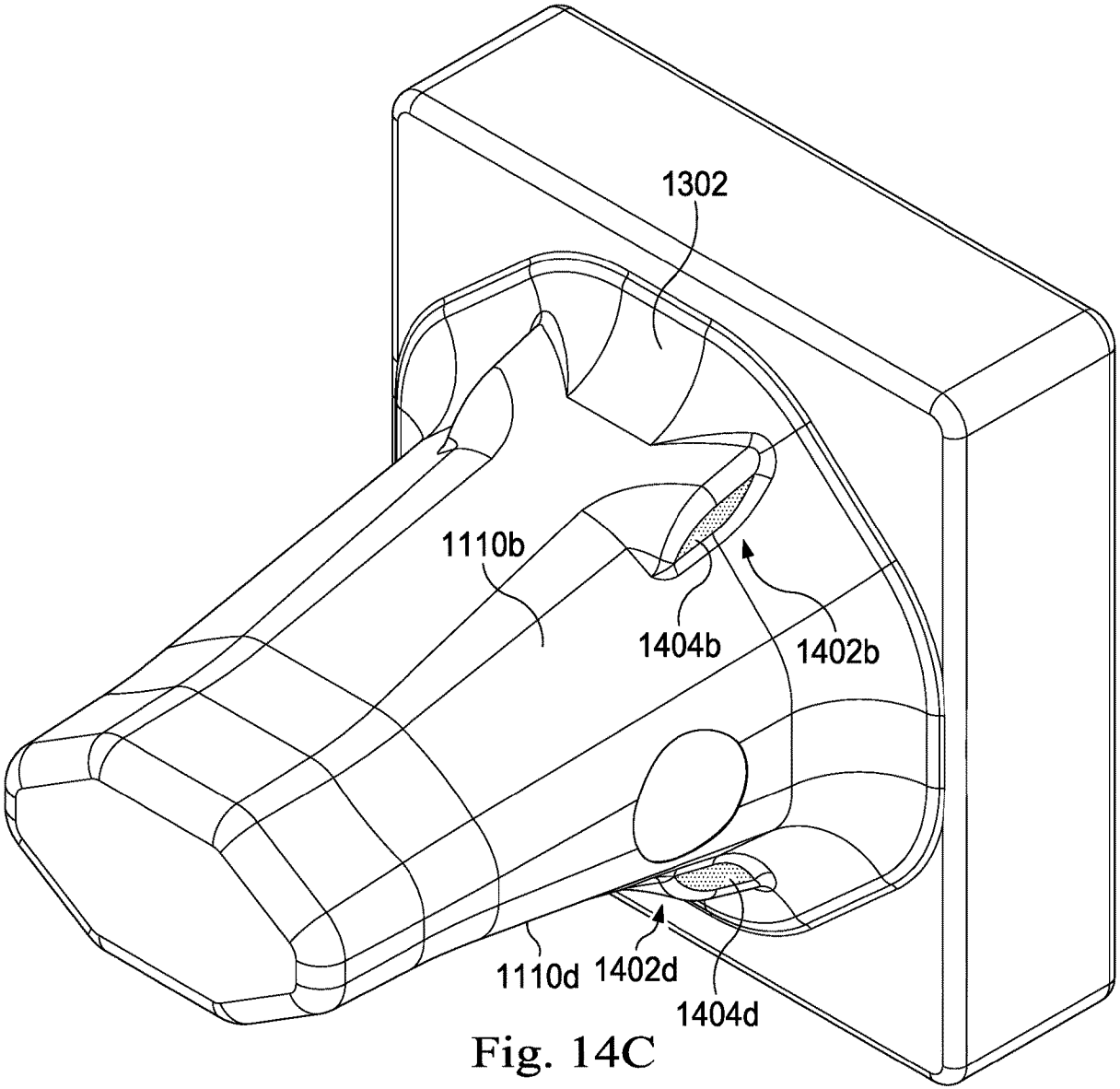
FIG. 14C illustrates a perspective view of an adapter nose with torsion control features according to one example of principles described herein.
Figure 14D:
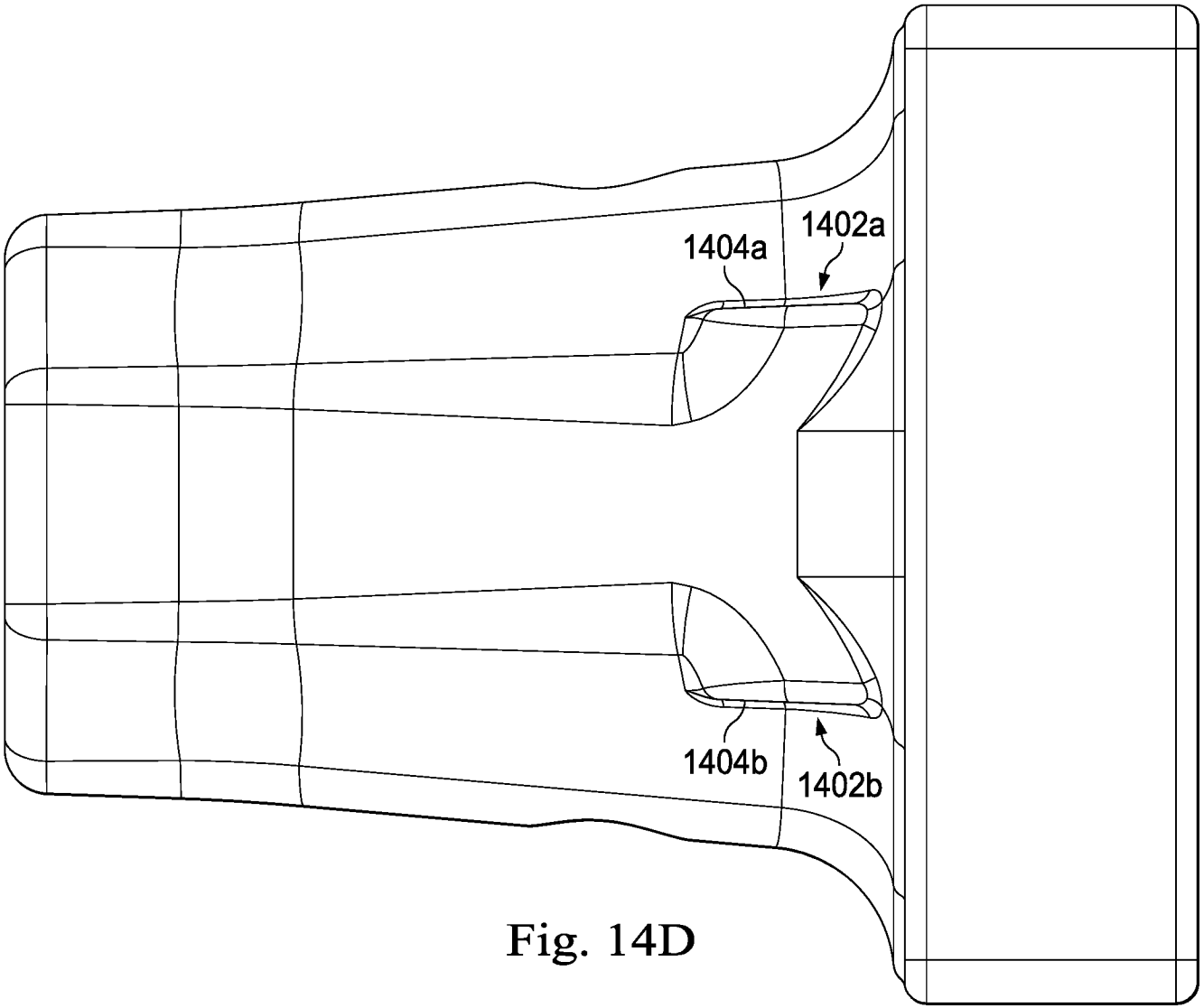
FIG. 14D illustrates a top view of an adapter nose with torsion control features according to one example of principles described herein.

FIG. 14A shows a view of an illustrative adapter nose 1400 with torsion control features 1402*a*, 1402*b*, 1402*c*, 1402*d* that resist torsional movement of the wear member 1200 with respect to the nose 1100. FIG. 14B shows a side view of the adapter nose 1400 with torsion control features. FIG. 14C is a perspective view of the adapter nose 1400 with torsion control features. FIG. 14D is a top view of the adapter nose 1400 with torsion control features. In the exemplary implementation shown, the adapter nose 1400 includes the angled bearing surfaces described with reference to FIGS. 11A, 11B, 11C, and 13. For convenience, these bearing surfaces will not be described again with reference to FIGS. 14A, 14B, 14C, and 14D. The torsion control features 1402*a*, 1402*b*, 1402*c*, 1402*d* comprise projections that extend from the nose 1400. Each of the torsion control features includes a vertical, planar, outwardly facing surfaces 1404*a*, 1404*b*, 1404*c*, 1404*d*. The torsion control features 1402*a*, 1402*b*, 1402*c*, 1402*d* are positioned near the rearward end of the adapter nose 1400. The torsion control features 1402*a*, 1402*b*, 1402*c*, 1402*d* are also positioned such that the vertical surfaces 1404*a*, 1404*b*, 1404*c*, 1404*d* intersect the angled bearing surfaces 1110*a*, 1110*b*, 1110*c*, 1110*d* of the nose 1400. As illustrated in FIG. 14D, the vertical surfaces 1404*a*, 1402*b*, 1402*c*, 1404*d* are tapered towards the longitudinal axis. This allows the tooth 1200 to be removed from the nose 1100 more easily.

As best seen in the side view of FIG. 14B, the torsion control features 1402*a*, 1402*b*, 1402*c*, 1402*d* are contained within the boundary created by the planar surfaces 1108*a* and 1108*b*. In the exemplary embodiment shown, the adapter nose 1400 includes torsion control features 1402*a*, 1402*b* disposed on an upper portion and includes torsion control features 1402*c*, 1402*d* disposed on a lower portion. In some implementations, the adapter nose 1400 includes torsion control features on only one of the upper portion or the lower portion. Also, in the implementation shown, the torsion control features 1402*a*, 1402*b* are shown vertically aligned with the torsion control features 1402*c*, 1402*d*. In some implementations, the torsion control features are not vertically aligned.

Figure 15:
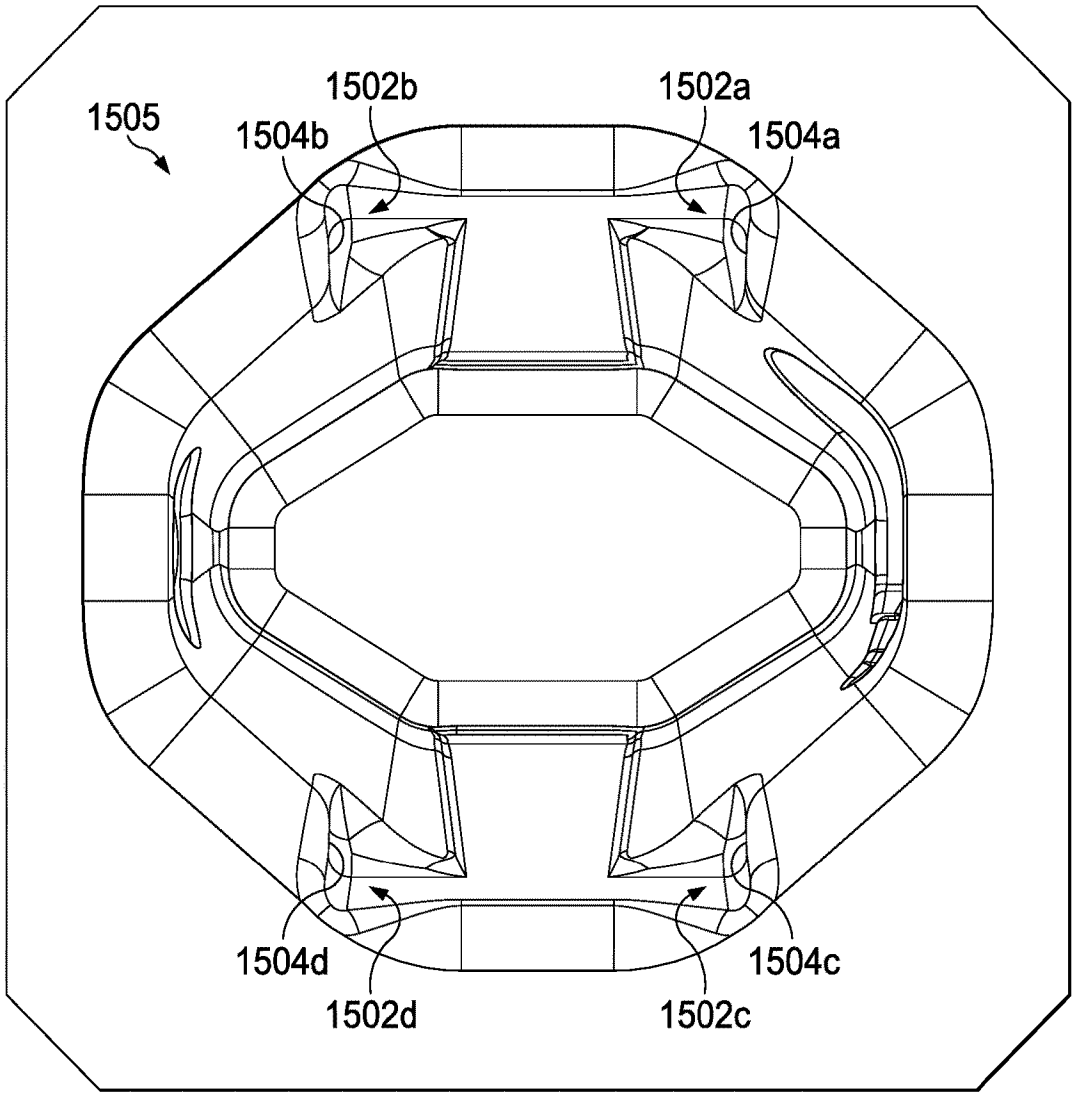
FIG. 15 illustrates a diagram showing a tooth having a cavity designed to fit an adapter nose with torsion control features according to one example of principles described herein.

FIG. 15 is a diagram showing a tooth 1500 having a cavity 1505 designed to fit an adapter nose, such as the adapter nose 1400, with torsion control features, such as the torsion control features 1402*a*, 1402*b*, 1402*c*, 1402*d*. The cavity 1505 may include a number of pockets 1502*a*, 1502*b*, 1502*c*, 1502*d*. The pockets 1502*a*, 1502*b*, 1502*c*, 1502*d* may be designed to receive the torsion control features 1402*a*, 1402*b*, 1402*c*, 1402*d* of the adapter nose 1400. In the exemplary implementation shown, the pockets 1502*a*, 1502*b*, 1502*c*, 1502*d* include vertical, planar, inward-facing surfaces 1504*a*, 1504*b*, 1504*c*, 1504*d* that correspond to the vertical surfaces 1404*a*, 1404*b*, 1404*c*, 1404*d* of the adapter nose 1400. Thus, the vertical surfaces 1404*a*, 1404*b*, 1404*c*, 1404*d* of the nose 1400 are designed to engage and interface with the vertical surfaces 1504*a*, 1504*b*, 1504*c*, 1504*d* of the tooth 1500 so as to resist twisting movement between the nose 1400 and the tooth 1500. The tooth 1500 may have, as indicated with reference to FIGS. 12A and 12B, planar bearing surfaces that interface with planar bearing surfaces on the adapter nose 1400.

Figure 16A:
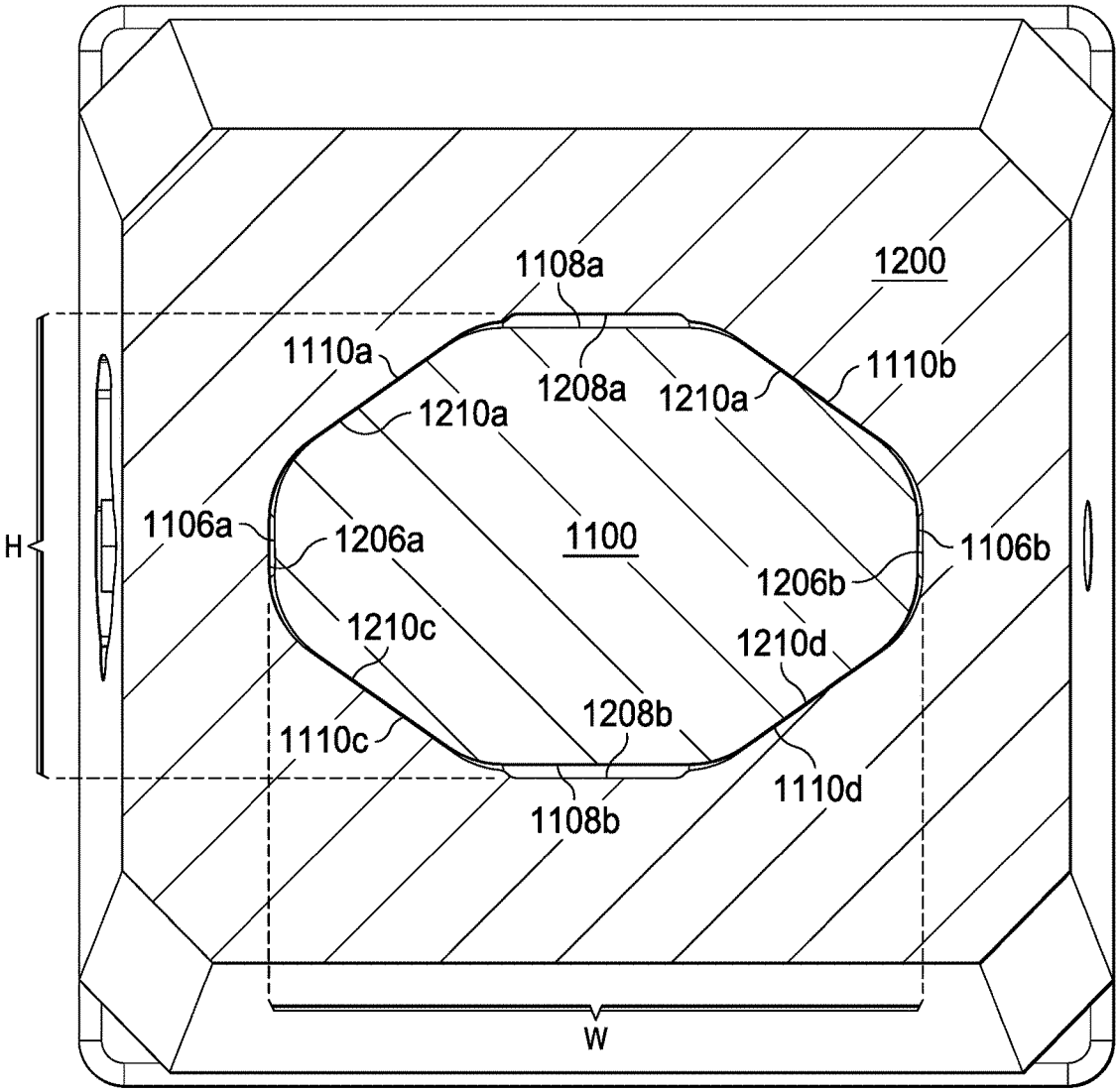
FIG. 16A illustrates a cross-section of the adapter nose orthogonal to the longitudinal axis according to one example of principles described herein.

FIG. 16A shows a cross-section of the adapter nose 1100 orthogonal to the longitudinal axis (e.g., 1105, FIG. 11B) in an assembled condition. Accordingly, FIG. 16A also illustrates the cross-section of the tooth 1200. As illustrated, the angled bearing surfaces 1110*a*, 1110*b*, 1110*c*, 1110*d* of the nose 1100 fit against the angled bearing surfaces 1210*a*, 1210*b*, 1210*c*, 1210*d* of the tooth 1200. These angled bearing surfaces minimize or prevent both vertical and lateral movement of the tooth 1200 relative to the adapter nose 1100. In some examples, there may be a gap between the horizontal non-bearing surfaces 1108*a*, 1108*b* of the nose and the horizontal non-bearing surfaces 1208*a*, 1208*b* of the tooth 1200. Likewise, there may be a gap between the vertical non-bearing surfaces 1106*a*, 1106*b* of the nose and the vertical non-bearing surfaces 1206*a*, 1206*b* of the tooth 1200. In some examples, however, the non-bearing surfaces of both the nose 1100 and the tooth 1200 may make contact when the tooth 1200 is fit over the nose 1100. Because of the angled bearing surfaces, both vertical and lateral movement may be minimized.

Figure 16B:
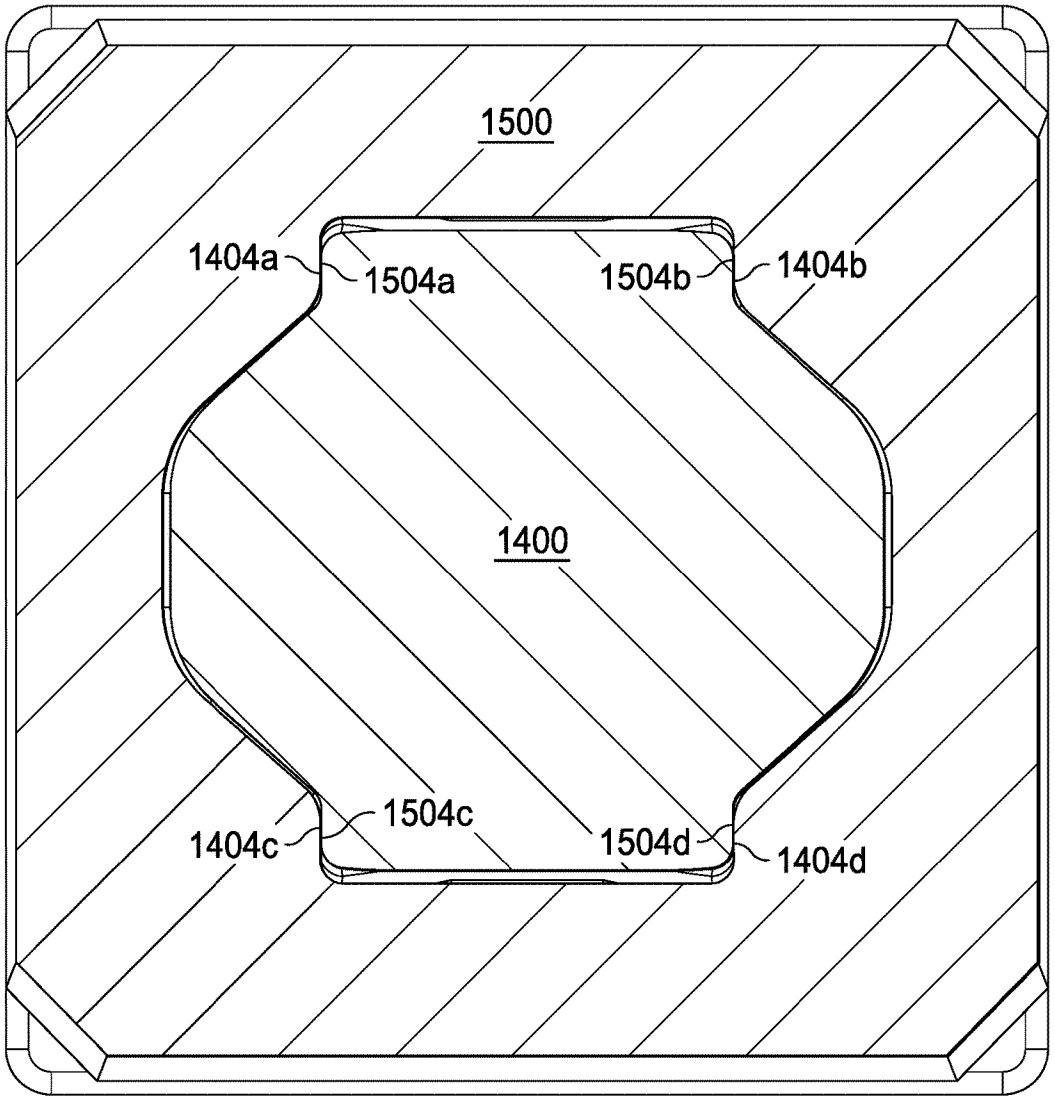
FIG. 16B illustrates a cross-section of the adapter nose with torsion control features orthogonal to the longitudinal axis according to one example of principles described herein.

FIG. 16B shows a cross-section orthogonal to the longitudinal axis of the adapter nose 1400 with torsion control features. As described above, the vertical surfaces 1404*a*, 1404*b*, 1404*c*, 1404*d* of the nose 1400 fit against the vertical surfaces 1504*a*, 1504*b*, 1504*c*, 1504*d* of the tooth 1500. Thus, the torsion control features 1402*a*, 1402*b*, 1402*c*, 1402*d* are arranged to resist twisting movement and torsion between the nose 1400 and the tooth 1500. This may help stabilize the tooth 1500 on the adapter nose 1400 during use.

Figure 16C:
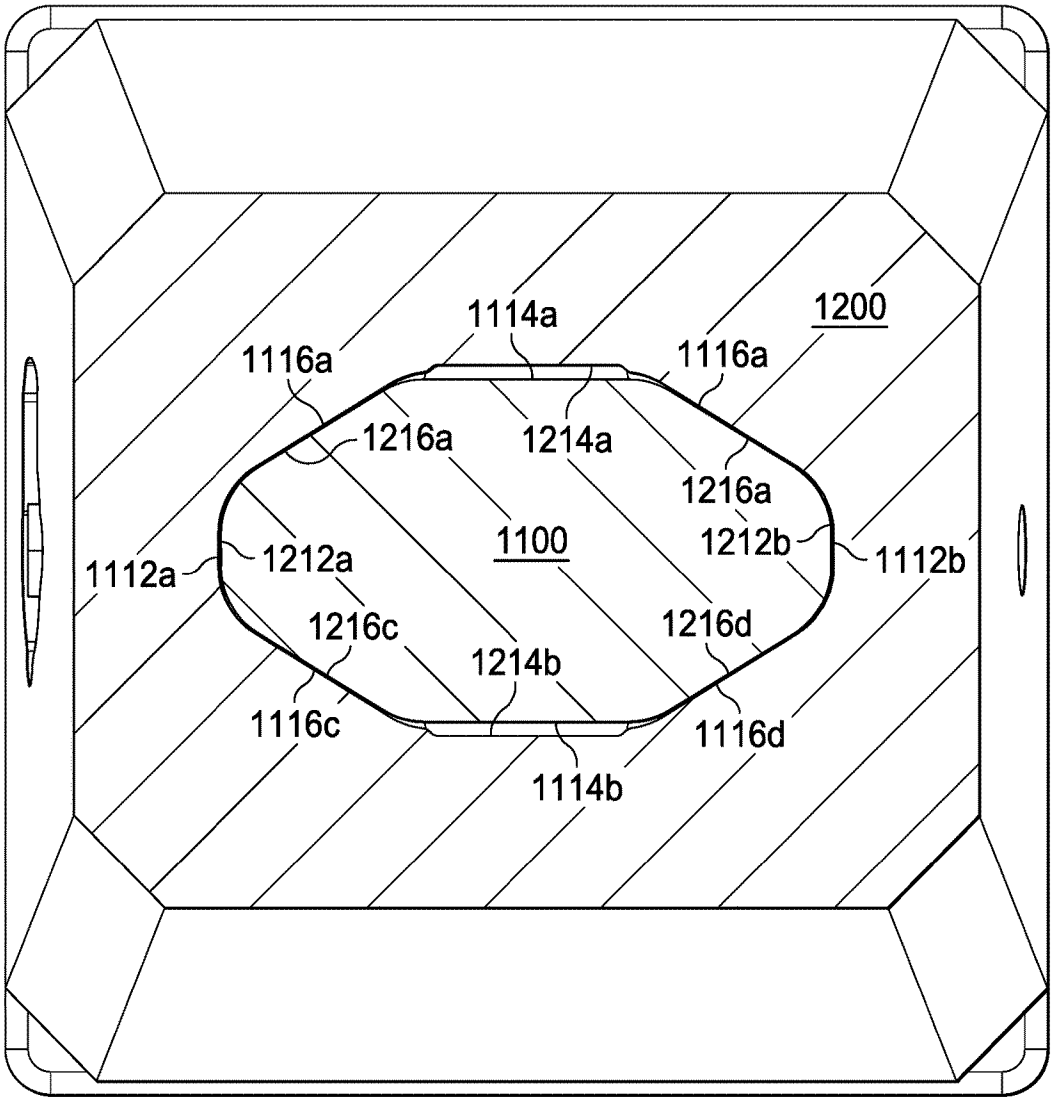
FIG. 16C illustrates a cross-section of the forward portion of the adapter nose according to one example of principles described herein.

FIG. 16C shows a cross-section of the forward portion of the adapter nose 1100. FIG. 16C also illustrates the cross-section of the tooth 1200. As illustrated, the angled bearing surfaces 1116*a*, 1116*b*, 1116*c*, 1116*d* of the nose 1100 fit against the angled bearing surfaces 1216*a*, 1216*b*, 1216*c*, 1216*d* of the tooth 1200. In some examples, there may be a gap between the horizontal non-bearing surfaces 1114*a*, 1114*b* of the nose and the horizontal non-bearing surfaces 1214*a*, 1214*b* of the tooth 1200. In the present example, the vertical surfaces 1112*a*, 1112*b* of the nose 1100 and the vertical surfaces 1212*a*, 1212*b* of the tooth 1200 are bearing surfaces and thus there is no gap between them. In some examples, however, there may be a gap between the vertical surfaces 1112*a*, 1112*b* of the nose 1100 and the vertical surfaces 1212*a*, 1212*b* of the tooth 1200. In this exemplary implementation, the angled bearing surfaces 1116*c* and 1116*d* are adjacent to, but do not form a part of, a bottom surface 1114*b* of the adapter nose 1100. This angled design may, in some instances, extend the useful life of the adapter nose 1100. It is not uncommon during use for an operator to wear a bottom portion of a tooth away, inadvertently exposing and wearing a bottom surface of the adapter nose 1100. In conventional systems utilising a bottommost surface of an adapter nose as a bearing surface, such where may adversely affect the stability of a subsequent tooth placed on the adapter nose. A worn bearing surface may introduce wobble, further accelerating wear, and potentially permanently damaging the adapter nose. However, the exemplary implementation disclosed herein includes bearing surfaces on angled bottom surfaces, rather than a horizontal bottom surface. Because of this, if an operator inadvertently wears away a portion of a bottom surface of the adapter nose, the angled bearing surfaces may still provide stability to the tooth in both the horizontal and vertical directions. This may increase the useful life of the adapter nose because the tooth may be properly supported even with a worn bottom surface of the adapter nose.

Figure 16D:
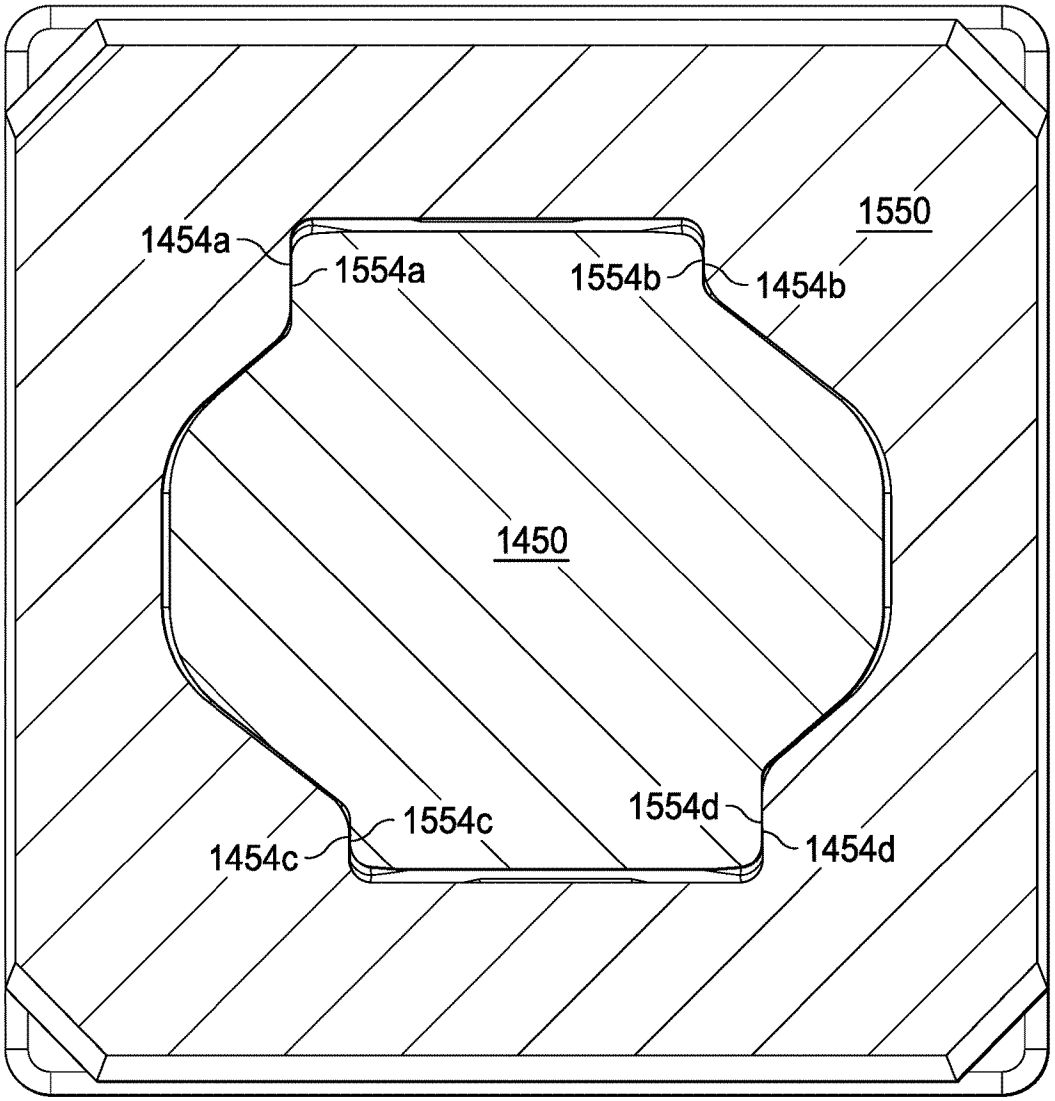
FIG. 16D illustrates a cross-section of the adapter nose with offset torsion control features according to one example of principles described herein.

FIG. 16D illustrates a cross-section of the adapter nose 1450 with offset torsion control features. For example, surface 1454*a* is offset from surface 1454*c*. Similarly, surface 1454*b* is offset from surface 1454*d*. The tooth 1550 includes corresponding surfaces 1554*a*, 1554*b*, 1554*c*, 1554*d*. The offsets are such that the tooth 1550 can still be flipped upside down and fit on the nose 1450. In other words, the tooth is engageable with the adapter nose 1450 in two rotational positions.

Although described as having eight planar surfaces, some implementations of the adapter noses and the teeth described herein include four angled planar surfaces and less than four planar vertical or horizontal surfaces. In some implementations, the adapter noses and teeth described herein include a round or arcing outer surface connecting two adjacent planar angled surfaces. For example, some implementations do not include the side vertical, with rounds connecting the adjacent surfaces 106*a* and 1106*b*. In these implementations, the surfaces 1106*a* and 1106*b* may be replaced with a round surface connecting planar bearing surfaces 1110*a* and 1110*c*. The tooth may be formed to match. In some implementations, the adapter nose may be formed with eight planar surfaces, but the cavity of the tooth, such as cavity 1205, may be formed with only six planar surfaces. In some examples, the vertical surfaces 1206*a* and 1206*b* described herein may be rounded, while the cavity 1205 may still be formed to engage and fit the planar angled bearing surfaces of the adapter nose.

U.S. Provisional Application No. 62/441,756 filed Jan. 3, 2017 and entitled "Connector with Clamp Spring for an Earth Engaging Wear Member Assembly" and U.S. Provisional Application No. 62/335,424 filed May 12, 2016 and entitled "Fastener for a Wear Member Assembly," are hereby incorporated by reference in the entirety.

Persons of ordinary skill in the art will appreciate that the implementations encompassed by the present disclosure are not limited to the particular exemplary implementations described above. In that regard, although illustrative implementations have been shown and described, a wide range of modification, change, combination, and substitution is contemplated in the foregoing disclosure. It is understood that such variations may be made to the foregoing without departing from the scope of the present disclosure. Accordingly, it is appropriate that the appended claims be construed broadly and in a manner consistent with the present disclosure.

What is claimed is:

1. A support structure arranged to receive a wear member, the support structure comprising:

a nose arranged to fit within a cavity of the wear member, the nose comprising:

a front portion having a plurality of outwardly facing surfaces, the outwardly facing surfaces angled with respect to a longitudinal axis of the nose at a first angle;

a rear portion having two horizontally separated outwardly facing surfaces, and two vertically separated outwardly facing surfaces, the horizontally separated outwardly facing surfaces and the vertically separated outwardly facing surfaces being angled with respect to the longitudinal axis at a second angle that is different than the first angle;

a first concave surface positioned on one of the vertically separated outwardly facing surfaces, the first concave surface being disposed only in the rear portion and shaped to form an arc;

a second concave surface positioned on the other of the vertically separated outwardly facing surfaces, the second concave surface being disposed only in the rear portion and shaped to form an arc; and a through-hole extending between the two horizontally separated outwardly facing surfaces, the through-hole arranged to receive a locking pin, and wherein the first concave surface and the second concave surface are positioned at least partially rearward of the through hole.

2. The support structure of claim 1, wherein a longitudinal length of the first and the second concave surfaces is larger than a transverse width of the first and the second concave surfaces.

3. The support structure of claim 1, wherein a transverse width of each of the concave surfaces is about 70% of a width of the vertically separated outwardly facing surfaces.

4. A support structure arranged to receive a wear member, the support structure comprising:

a nose arranged to fit within a cavity of the wear member, the nose comprising:

a front portion having a plurality of outwardly facing surfaces, the outwardly facing surfaces angled with respect to a longitudinal axis of the nose at a first angle;

a rear portion having two horizontally separated outwardly facing surfaces, and two vertically separated outwardly facing surfaces, the horizontally separated outwardly facing surfaces and the vertically separated outwardly facing surfaces being angled with respect to the longitudinal axis at a second angle that is different than the first angle;

a first concave surface positioned on one of the vertically separated outwardly facing surfaces, the first concave surface being disposed only in the rear portion and shaped to form an arc;

a second concave surface positioned on the other of the vertically separated outwardly facing surfaces, the second concave surface being disposed only in the rear portion and shaped to form an arc; and a pair of holes in the two horizontally separated outwardly facing surfaces, each hole of the pair of holes arranged to receive a locking pin, and wherein each hole comprises a portion that is forwardly of the concave surface.

5. The support structure of claim 4, wherein a longitudinal length of the first and the second concave surfaces is larger than a transverse width of the first and the second concave surfaces.

6. The support structure of claim 4, wherein a transverse width of the first and the second concave surfaces is about 70% of a width of the vertically separated outwardly facing surfaces.

7. The support structure of claim 4, wherein the pair of holes are openings to a horizontally extending through-hole shaped to receive a pin for attachment of the wear member.

* * * * *